US009999572B2

(12) United States Patent
Littell

(10) Patent No.: US 9,999,572 B2
(45) Date of Patent: Jun. 19, 2018

(54) SYSTEM FOR SEALING A CONTAINER FOR STORING AND DELIVERING A PRODUCT

(71) Applicant: Corwin Pearl Littell, Orlando, FL (US)

(72) Inventor: Corwin Pearl Littell, Orlando, FL (US)

(73) Assignee: READY MADE INC., Belle Isle, FL (US)

( * ) Notice: Subject to any disclaimer, the term of this patent is extended or adjusted under 35 U.S.C. 154(b) by 651 days.

(21) Appl. No.: 14/496,474

(22) Filed: Sep. 25, 2014

(65) Prior Publication Data

US 2016/0089305 A1 Mar. 31, 2016

(51) Int. Cl.

| | |
|---|---|
| ***A61J 9/00*** | (2006.01) |
| ***A61J 9/08*** | (2006.01) |
| ***A61J 11/00*** | (2006.01) |

(52) U.S. Cl.

CPC ..... *A61J 9/00* (2013.01); *A61J 9/085* (2013.01); *A61J 11/002* (2013.01)

(58) Field of Classification Search

CPC ... A61J 9/00; A61J 11/04; A61J 11/045; A61J 11/00; A61J 11/008

USPC ..... 215/11.1–11.6; 220/714; 604/74

See application file for complete search history.

(56) References Cited

U.S. PATENT DOCUMENTS

| | | | |
|---|---|---|---|
| 1,425,539 | A | 8/1922 | Paulsen |
| 2,047,270 | A | 7/1936 | Keenan |
| 2,075,249 | A | 3/1937 | Wilson |
| 2,628,912 | A | 2/1953 | Horan |
| 2,876,772 | A | 3/1959 | Witz |
| 2,956,702 | A | 10/1960 | Ransom et al. |
| 2,982,432 | A | 5/1961 | Mehl |
| 2,986,296 | A | 5/1961 | Bannister et al. |
| 3,138,278 | A | 6/1964 | Butts |

(Continued)

FOREIGN PATENT DOCUMENTS

| | | |
|---|---|---|
| WO | 2000/016668 | 3/2000 |

OTHER PUBLICATIONS

"Watch Demonstration" uploaded by Ready Made Single Use Baby Bottle, Nov. 1, 2013 [retrieved on Nov. 21, 2015] Retrieved from the Internet: <URL: https://www.youtube.com/watch?v=7J7W1a9GxJ0>.

(Continued)

*Primary Examiner* — Fenn C Mathew
*Assistant Examiner* — Cynthia Collado
(74) *Attorney, Agent, or Firm* — Terry M. Sanks, Esq.; Beusse Wolter Sanks & Maire, PLLC

(57) ABSTRACT

In an embodiment, a system including a closure device, the closure device including an opening for providing fluid communication there through, an outflow component configured to be disposed over the closure device, the outflow component including an outflow aperture to provide fluid communication between the outflow component and a user, and a securing member for supporting the outflow component in a position over the closure device is provided. The system further includes a stopper component removably engageable with the opening of the closure device, wherein when the stopper component is engaged with the opening, the stopper component obstructs the opening preventing a flow of fluid through the opening, and wherein displacement of the stopper component from the opening allows fluid communication through the opening.

20 Claims, 24 Drawing Sheets

(56) References Cited

U.S. PATENT DOCUMENTS

| | | | | |
|---|---|---|---|---|
| 3,219,221 | A | 11/1965 | Ballin | |
| 3,289,874 | A | 12/1966 | Dailey et al. | |
| 3,358,864 | A | 12/1967 | Meierhoefer | |
| 3,439,824 | A | 4/1969 | Merrill, Jr. et al. | |
| 3,477,603 | A | 11/1969 | Koll | |
| 3,531,009 | A | 9/1970 | Saperstein | |
| 3,567,060 | A | 3/1971 | Ballin | |
| 3,572,533 | A | 3/1971 | Koll | |
| 3,902,618 | A | 9/1975 | Guerster et al. | |
| 3,952,897 | A | 4/1976 | Pickerell et al. | |
| 4,534,482 | A | 8/1985 | Bouche | |
| 4,560,081 | A | 12/1985 | Adams | |
| 5,704,500 | A * | 1/1998 | Hoffmann | A61J 9/008 215/11.6 |
| 5,791,503 | A * | 8/1998 | Lyons | A61J 9/00 215/11.1 |
| 5,878,898 | A | 3/1999 | Shefflin | |
| 6,286,697 | B1 | 9/2001 | Gasparini | |
| 7,108,676 | B2 * | 9/2006 | Loging | A47G 19/2272 220/714 |
| 7,938,281 | B2 | 5/2011 | Horntrich et al. | |
| 8,091,718 | B2 | 1/2012 | Yu et al. | |
| 8,100,276 | B2 | 1/2012 | Moor | |
| 8,490,803 | B2 | 7/2013 | Harris | |
| 9,138,088 | B2 * | 9/2015 | Kemper | A47G 19/2272 |
| 2001/0027956 | A1 * | 10/2001 | Bonacorso | A61J 9/00 215/11.1 |
| 2005/0045647 | A1 * | 3/2005 | Hession | A47G 19/2272 220/714 |
| 2005/0121405 | A1 | 6/2005 | Drajan | |
| 2005/0184076 | A1 | 8/2005 | Chang et al. | |
| 2005/0194341 | A1 * | 9/2005 | Houraney | A61J 9/00 215/11.1 |
| 2008/0210656 | A1 | 9/2008 | Mensah-Ouvor et al. | |
| 2009/0139949 | A1 | 6/2009 | Py et al. | |
| 2010/0193459 | A1 | 8/2010 | Housley | |
| 2013/0056435 | A1 | 3/2013 | Itzek | |

OTHER PUBLICATIONS

International Search Report, dated Dec. 22, 2015.

* cited by examiner

SYSTEM FOR SEALING A CONTAINER FOR STORING AND DELIVERING A PRODUCT

FIELD OF INVENTION

Embodiments relate generally to product dispensing containers and assemblies and more specifically containers designed for infant feeding.

BACKGROUND

Numerous storage and feeding containers exist in the market. More specifically, numerous storage and feeding containers for infants are currently available. Most of these solutions, however, fail to provide an effective, one-time use bacteria-free storage and feeding environment for users. Many of the currently available solutions are easily contaminated by handling the parts in order to assemble, fill and/or refill the container. Studies have shown that the cross-contamination of bacteria from a person who assembles an infant bottle is a leading cause of infantile death. Consequently, there is a need for an easy to use, one-time use effective, sterile feeding container.

SUMMARY

A system configured to be mounted on a container for storing and dispensing a product is provided. The system may include a closure device configured to be disposed over a mouth portion of the container, the closure device including an opening for providing fluid communication between the container and a user, an outflow component including an upper portion and a base, and configured to be in a folded position when not in use and an unfolded position to dispense the product to the user, the upper portion of said outflow component comprising an outflow aperture to provide a fluid communication between the outflow component and the user, a securing member for supporting the outflow component in a position over the closure device, the securing member configured to receive the outflow component when said outflow component is in the folded position, and an enclosure member configured to be removably engageable with the securing member, wherein when the enclosure member is engaged with the securing member, the outflow component is compressed into a folded position, wherein at least a portion of the base of the outflow component obstructs the opening of the closure member during storage of the product, wherein when the enclosure member is disengaged from the securing member, the outflow component is released into the unfolded position, providing fluid communication through the opening of the closure device to dispense the product to the user.

In another embodiment, a system including a closure device, the closure device including an opening for providing fluid communication there through, an outflow component configured to be disposed over the closure device, the outflow component including an outflow aperture to provide fluid communication between the outflow component and a user, a securing member for supporting the outflow component in a position over the closure device is provided. The system further includes a stopper component removably engageable with said opening of said closure device, wherein when the stopper component is engaged with the opening, the stopper component obstructs the opening preventing a flow of fluid through the opening, and wherein displacement of said stopper component from the opening allows fluid communication through the opening.

In another embodiment, a container is provided. The container may include a housing for storing and delivering a product to a user, the housing having an opening for providing a fluid communication between the housing and a user. The container may also include an outflow component. In some, non-limiting embodiments, the outflow component may include a resilient material. The outflow component may include a upper portion, a base, and an outflow aperture, wherein the outflow aperture is configured to provide a fluid communication between the outflow component and the user, the outflow component configured to be disposed over the opening in the housing, and an enclosure member may be configured to be removably coupled to the housing, wherein when the enclosure member is disposed over the outflow component, the outflow component is compressed into a folded position such that at least a portion of the base of the outflow component obstructs the opening of the closure member during storage of the product, and wherein when the enclosure member is displaced from the outflow component, the outflow component is released into the unfolded position, providing fluid communication through the opening of the housing such that the product can be delivered to the user.

In another embodiment, a closure device configured to associate with a mouth of a container for storing and dispensing a product is provided. The closure device may include an upper surface and a lower surface, wherein the lower surface is in communication with the container, an opening, the opening providing a fluid communication from the container through the closure device for dispensing the product from the container, a stopper component, the stopper component may be configured to obstruct the opening of the closure device when the stopper component is in an active position, and the stopper component may be configured to move above the horizontal plane of the closure device to allow the product to be dispensed from the container through the opening when the stopper component is in an inactive position.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
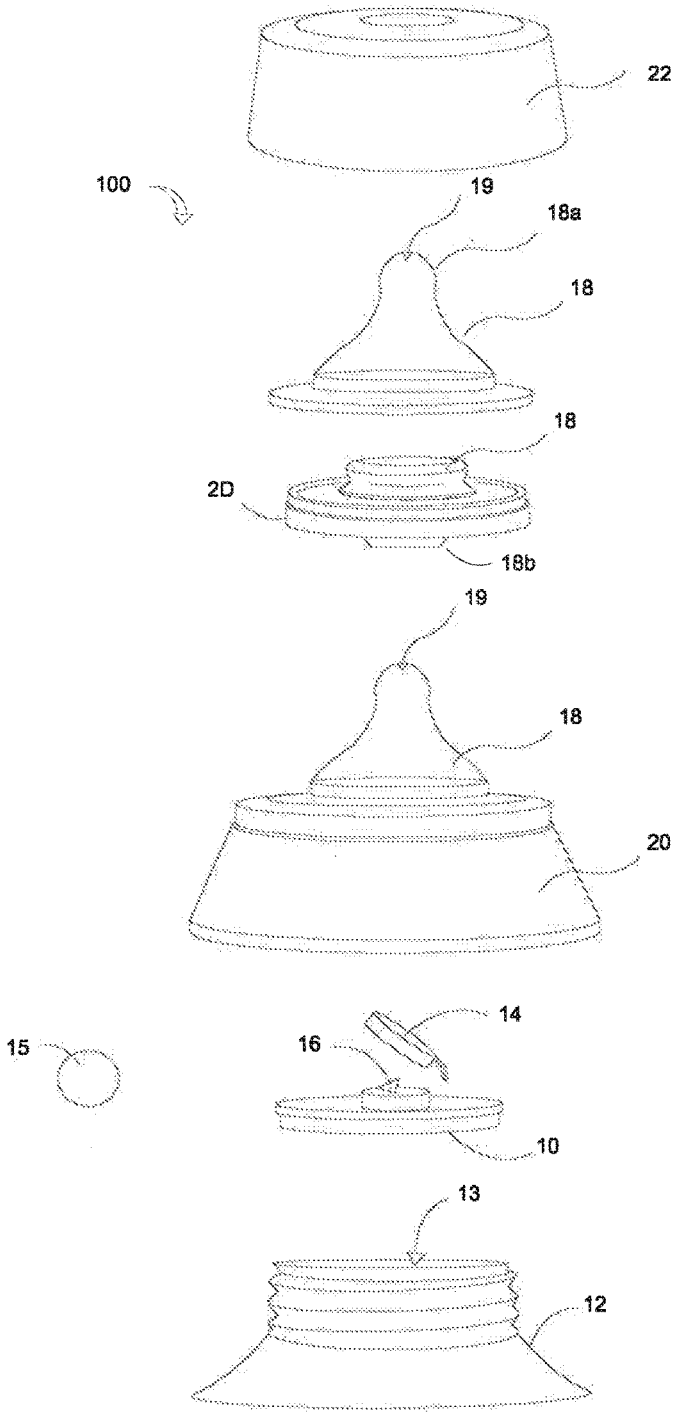
FIG. 1 is an exploded view of an embodiment of a system described herein.

For the purposes of promoting an understanding of the principles and operation of embodiments disclosed herein, reference will now be made to the embodiments illustrated in the drawings and specific language will be used to describe the same. It is important to an understanding of the embodiments to note that all technical and scientific terms used herein, unless defined herein, are intended to have the same meaning as commonly understood by one of ordinary skill in the art. The techniques employed herein are also those that are known to one of ordinary skill in the art, unless stated otherwise. For purposes of more clearly facilitating an understanding as disclosed and claimed, herein, the following definitions are provided.

It is to be noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

The terms "closure device", "closure member", "teat ring filler hole plate" may be used interchangeably herein to refer to a portion or element of system herein that covers over an opening (i.e., mouth) of a container, for example. The closure device may fit within the walls of the mouth of the container in one non-limiting example. In another non-limiting example, the closure device may contact the inner walls of the mouth or other portion of the container to provide an air or fluid-tight fit there within. In another non-limiting example, the closure device may be disposed over and/or affixed to the mouth of the container.

The terms "outflow component aperture" and "teat hole" may be used interchangeably herein to refer to the opening in the outflow component which provides fluid flow from the output component to a user allowing delivery of a product from the container to the user. The terms "outflow component", "nipple" or "teat" as used herein, refers to the portion of the system or device which dispenses or delivers the contents or the product of the container to a user. The outflow component may be shaped like a bottle nipple as shown in the embodiments herein, or may include other shapes and form factors, including, but not limited to a straw, a spout, simply an opening in a component of the system, device or container described herein, or any other type of outflow component engageable by a user to receive a product there through.

The terms "opening" and "filler hole" may be used interchangeably herein to refer to the opening within the closure device or within a portion of a housing of a container described herein, which allows a flow of fluid through the closure device.

The terms "enclosure member", "safety cap", or "cap" can be used interchangeably herein to refer to the portion of the device or system herein which covers over the system, the closure device, or the outflow component.

The terms "protrusion member" and "teat hole extension" may be used interchangeably herein to refer to the portion of the enclosure member which extends down and is configured to contact, in some non-limiting embodiments, the outflow component aperture when the enclosure member is engaged over the outflow component. The terms "protrusion member head" and "teat hole clearing device" may also be used interchangeably herein.

The term "associated" or "association," as used herein, includes but is not limited to direct and indirect attachment or contact, adjacent to, in contact with, partially or fully attached to, and/or in close proximity therewith. The attachment or contact may further include a temporary or permanent attachment or contact in non-limiting embodiments.

As used herein, the terms "subject," "user," and "infant" are used interchangeably. As used herein, the term "subject" refers to an animal, preferably a mammal such as a non-primate (e.g., cows, pigs, horses, cats, dogs, rats etc.) and a primate (e.g., monkey and human), and more preferably a human, most preferably a human infant.

"Container" as used herein refers to a housing for a product, the product may include a solid, liquid or a gas. The container may include, but is not limited to including medication, proteins, food, water, and vitamins. Medicine that may be contained within the container includes anti-AIDS medications, vitamins or vitamin-enriched liquids, or antibiotics, in non-limiting examples. The container may, but is not limited to contain or house a liquid for feeding animals, particularly for feeding humans. In one non-limiting example, a container includes a bottle used for feeding.

It has been identified herein that contamination of containers and associated components used for feeding is an ongoing problem, particularly in infant-bottle feeding environments. Typical infant bottles require filling and assembly of the parts of the bottle prior to a feeding event. Oftentimes these bottles are cross-contaminated with bacteria from the environment, which results in the overall contamination of the product contained therein. Consequently, a ready-made container or system, which may be pre-assembled during manufacturing, in some non-limiting embodiments, and pre-filled with the product to be stored and delivered to a user such that no preparation or handling of the product or the individual components of the container or system prior to use would significantly reduce or eliminate contamination of the container, system or product before use.

A ready-made container or system would save time and provide a safe, effective, and efficient method of delivering a product to a user, be it an adult, a child or an animal. Therefore, many industries could benefit from such a bacteria-free, ready-made container or system used for delivering a product to a user, including but not limited to the sports industry, healthcare industry, child care industry, and animal care industry.

Embodiments are unique in that each provide many benefits, including but not limited to the following: 1) a new way to feed or provide fluid or medication to infants, adults or animals wherein new components are used to feed, provide fluid, or medication to the user at each feeding, fluid-providing, or medicating event, 2) delivery of a bacteria-free, sterile product to a user every time it is used, and 3) an infant, adult or animal product that does not require any preparation and is in a ready to serve form whenever needed, 4) a one-time use disposable and/or recyclable container for feeding or providing fluid or medication.

Embodiments provided herein include a system for mounting or attaching to a container wherein the container contains a product for delivery via the system to a user. The system may include a closure device configured to be disposed over an opening or mouth portion of the container, the closure device is configured to provide fluid communication between the container and the system, for delivery of the product in the container to the user. The system may further include an outflow component with an outflow aperture for delivering the product to the user, a securing member for supporting the outflow component in a position over the closure device and an enclosure member configured to be removably engageable with the securing member and disposable over the outflow component during storage of the container and/or product and prior to or following use of the product. The enclosure member at least partially covers the outflow component so as to prevent contamination of the outflow component.

The outflow component may include an upper portion and a base portion and may include a resilient material, in one embodiment. The material may include, in non-limiting embodiments, a plastic, rubber or silicone material, which can be compressed or folded and retain its shape when released or unfolded. The outflow component may be compressed, in one embodiment, by the enclosure member such that the outflow component is folded or collapses into the securing member. When the outflow component is folded or collapsed into the securing member, a portion of the outflow component, for example, the base portion, may contact the closure device so as to form a seal there between. This seal may be a fluid-tight seal so as to prevent any flow of fluid there through. In this embodiment, when the outflow component is collapsed into the securing member, the opening of the closure device is sealed such that prior to use of the container for dispensing the product contained therein, the product will not leak out of the container, and furthermore, the product will remain bacteria-free until use. Upon removal of the enclosure member, the outflow component will be released into its unfolded or expanded position, such that fluid communication through the opening of the closure device is provided. Consequently the product of the container may flow through the opening into the outlet component to be delivered or dispensed to a user.

In other embodiments, a stopper component may be provided to obstruct the opening in the closure device or housing of the container during storage of the product and/or container. Prior to use or dispensing of the product, the stopper component may be displaced from the opening to allow delivery of the product form the container through the opening in the closure device or housing of the container to the user. There are various actuation devices and methods described herein for the manipulation of the stopper component and other components of the system to selectively obstruct the opening preventing fluid communication there through, and unobstruct, or clear the opening when fluid flow is desired.

Embodiments herein include, as illustrated in the exploded view of a system 100 in FIG. 1, a closure device 10 configured to be placed on or disposed over a container 12 having an opening or a mouth 13. A stopper component 14 may be provided to engage with or be disposed over an opening 16 in the closure device. An outflow component 18 having an upper portion 18*a* a base portion 18*b*, and an outflow aperture 19 is provided, wherein the outflow component 18 is configured to be disposed or positioned over the closure device 10. A securing member 20 for supporting the outflow component 18 in a position over the closure device 10 may also be provided as shown herein. The securing member 20 may be configured to receive the outflow component 18 when the outflow component 18 is in a folded position as shown in FIG. 1. When assembled, the base portion 18*b* of the folded outflow component 18 compresses the stopper component 14 into the opening 16. An enclosure member 22 is further provided in FIG. 1, the enclosure member is configured to be removably engageable with either the outflow component 18 or the securing member 20. When engaged to the outflow component 18 or the securing member 20, the enclosure member 22 may compress the outflow component 18 into a folded state. A ball stopper component 15 may be used in addition to or as an alternative to stopper 14, to cover the opening 16 in another non-limiting embodiment.

Figure 2B:
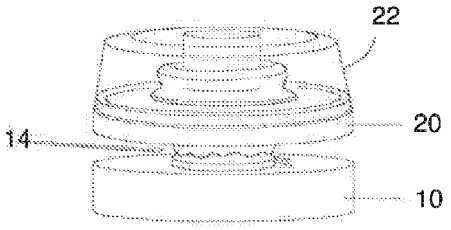
FIG. 2B is a sectional view of a portion of the system embodiment shown in FIG. 2A.
Figure 2C:
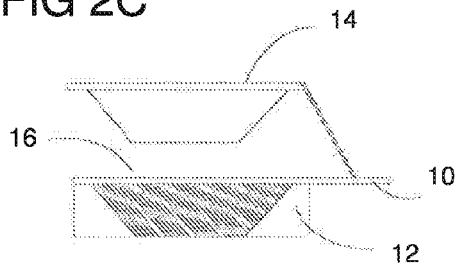
FIG. 2C is a cross sectional view of a stopper component embodiment.
Figure 2A:
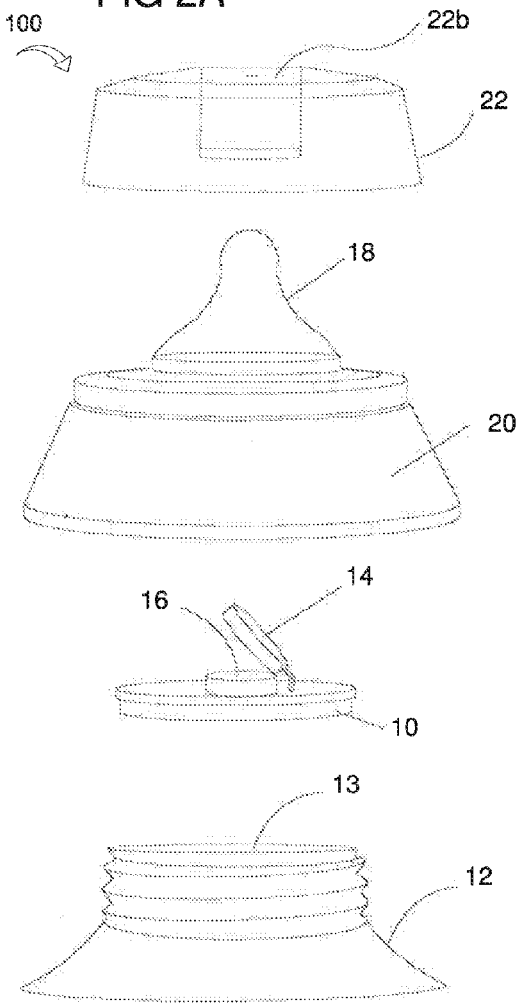
FIG. 2A is an exploded view of a further system embodiment.

FIG. 2A provides another exploded view of the system 100, wherein the enclosure member 22 includes an outflow component sleeve 22*a*, and a protrusion member 22*b* in a non-limiting embodiment. The protrusion member 22*b* may extend from an inner surface of the enclosure member 22, and may include a protrusion member head 22*c* at its distal end. The protrusion member 22*b* and/or the protrusion member head 22*c* may be used to clear an obstruction or remove any debris that may collect in the outflow component aperture 19 when the enclosure member 22 is placed onto the outflow component 18 such that the protrusion member 22*b* or the protrusion member head 22*c* contacts the outflow component aperture 19. FIG. 2B provides a perspective view of an embodiment of the system 100, once assembled. In the embodiment shown in FIG. 2B, the outflow component 18 is folded or collapsed into the securing member 20, and the stopper component 14 is at least partially compressed into the opening 16 in the closure device 10 preventing fluid communication there through.

FIG. 2C provides a cross sectional view of one embodiment of a stopper component 14 disposed above the opening 16 of a closure device 10 provided on a container 12. The shape and size of the stopper component 14 may vary and is not limited to the shapes that are shown in the figures herein. However, the stopper component 14 may be of a shape and size configured to fit at least partially within the opening 16 of the closure device, in a non-limiting embodiment. In a further embodiment, the stopper component may be of a shape and size to further fit within at least a portion of the opening of the container 12.

Figure 3:
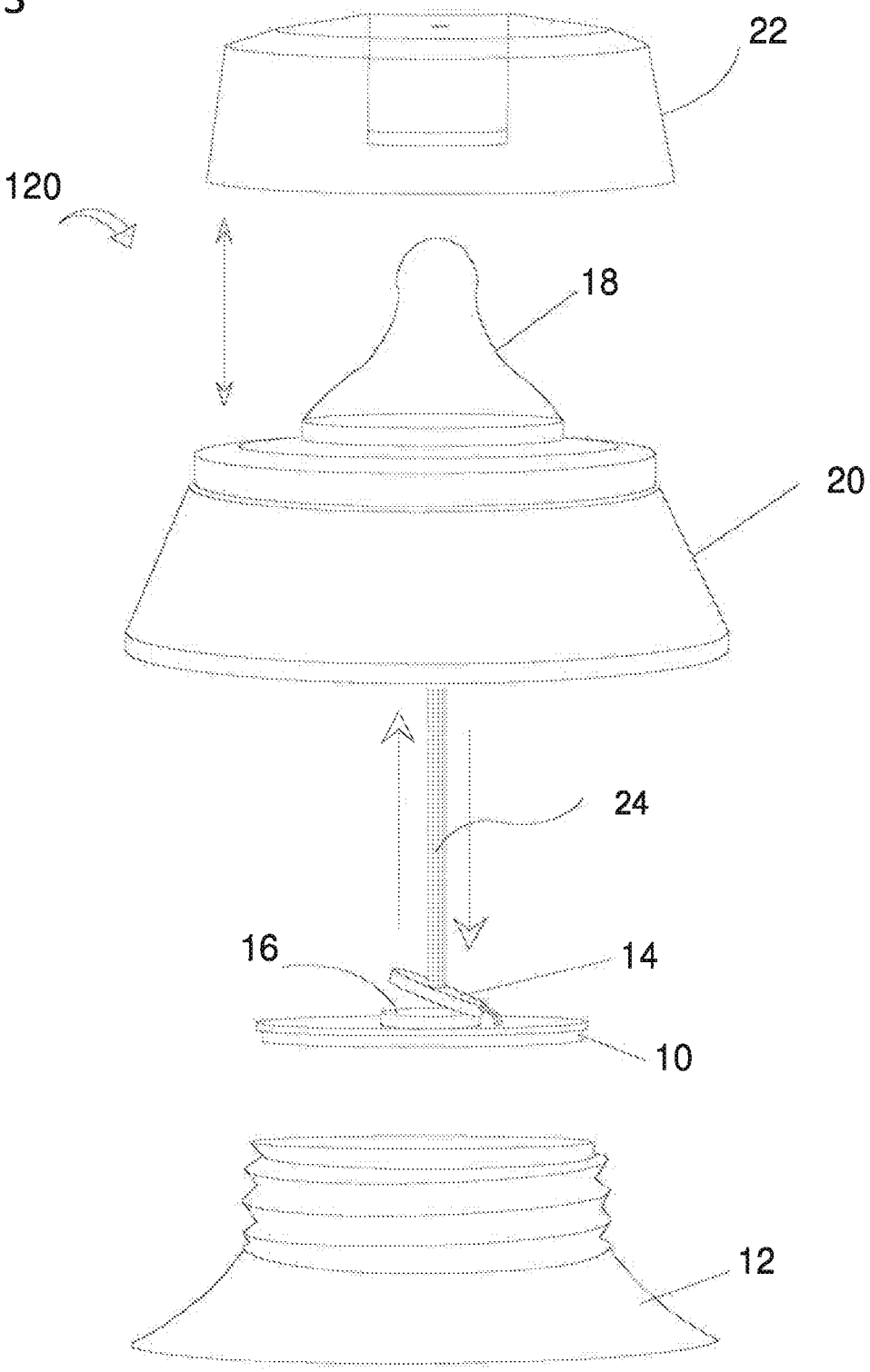
FIG. 3 is an exploded view of an embodiment of the system.

In another system embodiment 120 shown in the exploded view of FIG. 3, the enclosure member 22, outflow component 18, securing member 20, stopper component 14 closure device 10 and a portion of a container 12 are provided. The enclosure member 22 may include an enclosure member projection 24 extending there from, in a non-limiting embodiment, such that upon that placing of the enclosure member 22 over the outflow component 18 the enclosure member projection 24 compresses the stopper component 14 to obstruct the opening 16 and prevent a flow of fluid there through. Once the enclosure member 22 is removed from the outflow component 18, the enclosure member projection 24 is removed there from, and the stopper component 14 is displaced from the opening 16.

Figure 4:
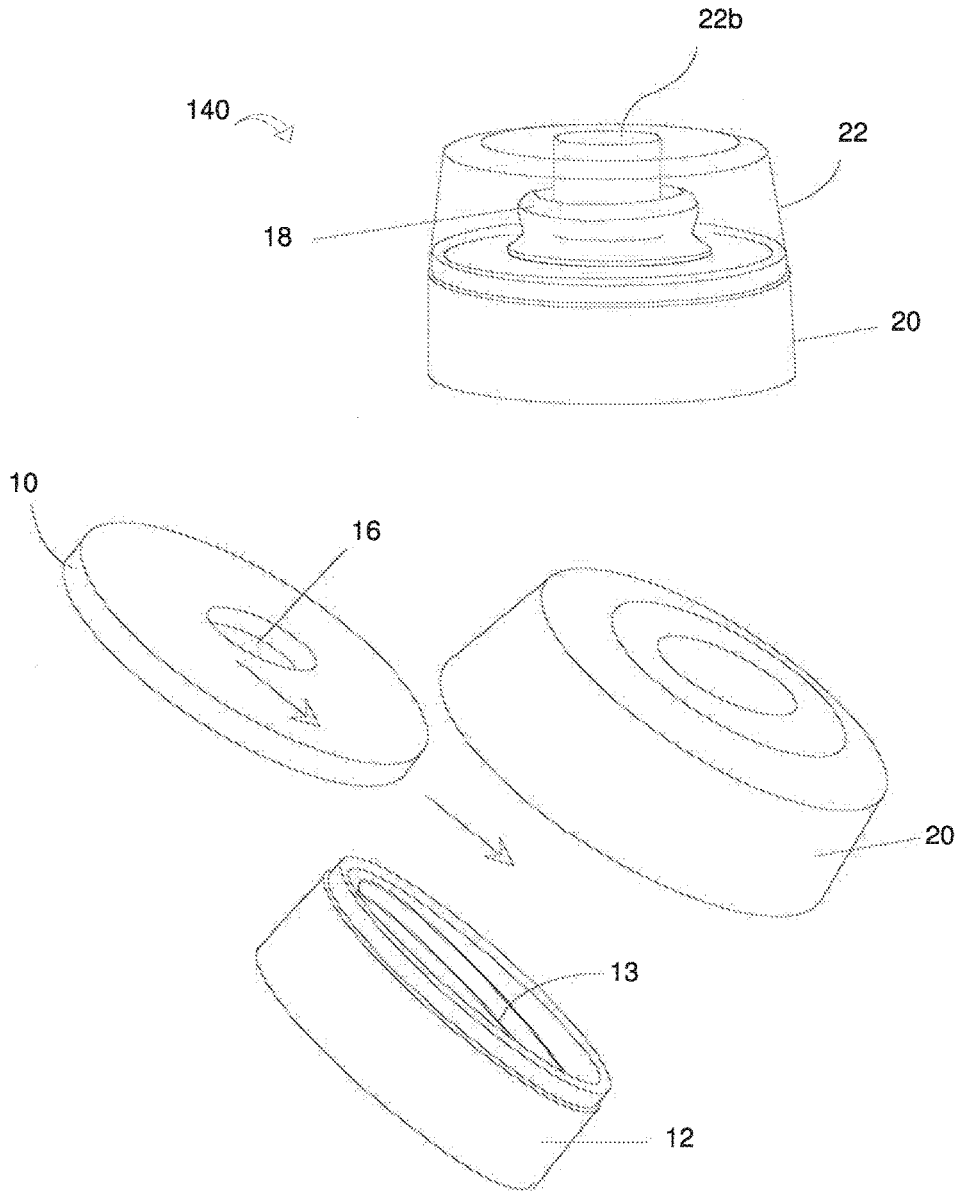
FIG. 4 is an exploded view of a further system embodiment.

In still another system embodiment 140 shown in the assembled state in FIG. 4A and partially exploded, partially unassembled state in FIG. 4B, when the outflow component 18 is in the folded state (as shown) held within the securing member 20, the outflow component base portion 18*b* is compressed over the opening 16 in the closure device 10 which is disposed over the container 12, when provided on the container 12. The outflow component base portion 18*b* contacts a portion of the closure device 10 to form a seal there between. In this embodiment 140, the opening 16 may further be sealed by the base of the outflow component 18*b*. As a result, fluid communication through the opening 16 is prevented. The folding of the outflow component 18 may be caused by the placement of the enclosure member 22 over the outflow component 18. Subsequent removal of the enclosure member 22, therefore, allows the outflow component 18 to revert to its original shape (i.e., unfold, uncompress, release) removes the seal between the components, and allows fluid to flow through the opening of the closure device from the container 12 into the outflow component 18 and to the user.

Figure 5:
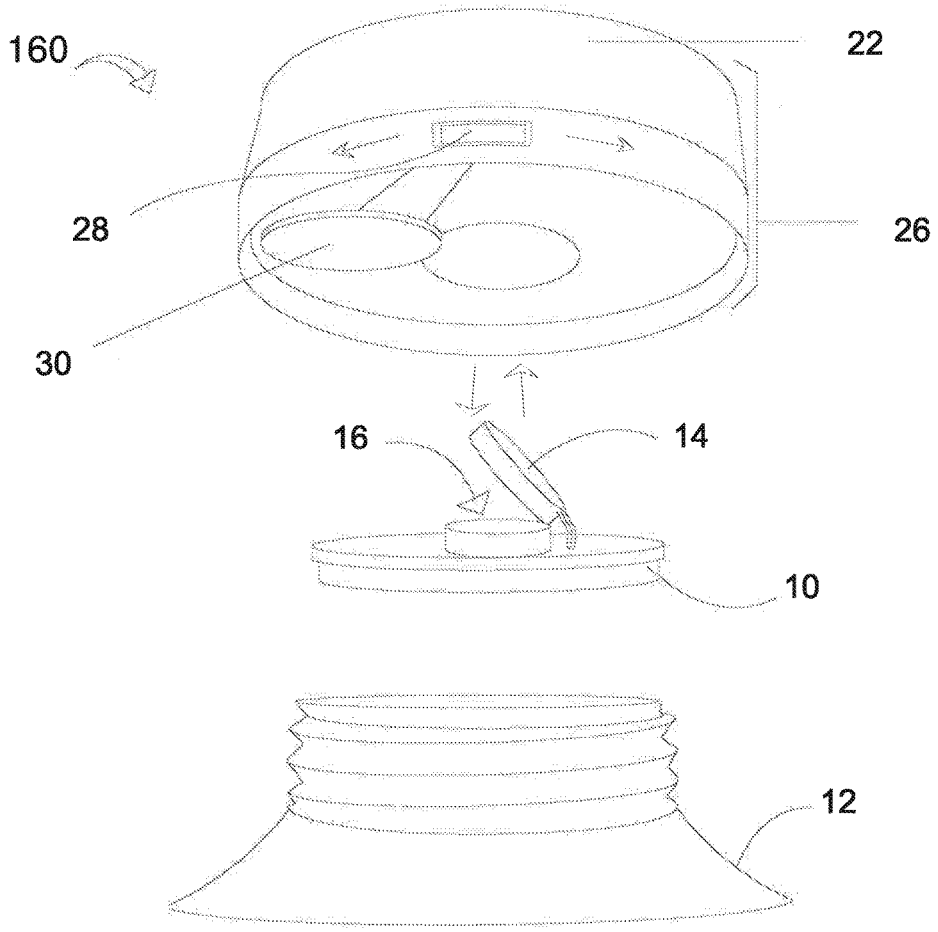
FIG. 5 is an exploded view of another system embodiment.

FIG. 5 provides a partially exploded view of a system embodiment 160, wherein the enclosure member is surrounded by a protective cover 26. The protective cover 26 may be disposed over at least a portion of the enclosure member 22 and/or additional components of embodiments of the system herein. In one non-limiting example, the protective cover 26 may include a plastic material to protect and keep sanitary the components of the system disposed there under. The protective cover 26 may include, in a non-limiting embodiment, a sealing wrap that covers the entire system, container, or a portion thereof. In one non-limiting embodiment shown in FIG. 5, a trigger switch 28 may be provided on a portion of the securing member 20, container 16, enclosure member 22, or other portion of the system. The trigger switch 28 may be associated with a triggering element 30, wherein the triggering element 30 is configured to associate with the stopper component 14. The association between the triggering element 30 and the stopper component 14 is such that movement of the stopper component 14 is affected by movement of the triggering element 30 and/or the trigger switch 28. In one non-limiting embodiment, movement of the trigger switch 28 effects movement in the triggering element 30 such that releasing the trigger switch 28 would release the triggering element 30 from contact with the stopper component 14. The reverse relationship may occur in an alternate embodiment, wherein release of the trigger switch 28 would activate the triggering element 30 compressing it into the stopper component 14, causing the stopper component 14 to at least partially obstruct the opening 16 in a non-limiting embodiment. The movement of the triggering element 30 relative to the stopper component 14 may be a horizontal movement and/or a vertical movement in non-limiting embodiments. Additionally, the trigger switch 28 may be compressed and released to activate and move the triggering element 30, but in an alternative embodiment, the trigger switch 28 may be shifted from left to right, or moved horizontally relative to the longitudinal axis of the container to activate and move the triggering element 30 as would be understood by one skilled in the art.

In a further non-limiting embodiment, the protective cover 26 may provide a pressure on the trigger switch 28, such that once the protective cover 26 is removed, the trigger switch 28 is released, releasing the triggering element 30, displacing the stopper component 14 from the opening 16, allowing fluid communication through the opening 16, for example. The reverse may also occur, in an alternative embodiment, wherein removal of the protective cover 26 may release the trigger switch 28 to move the triggering element 30 to contact the stopper component 14 as described above.

Figure 6A:
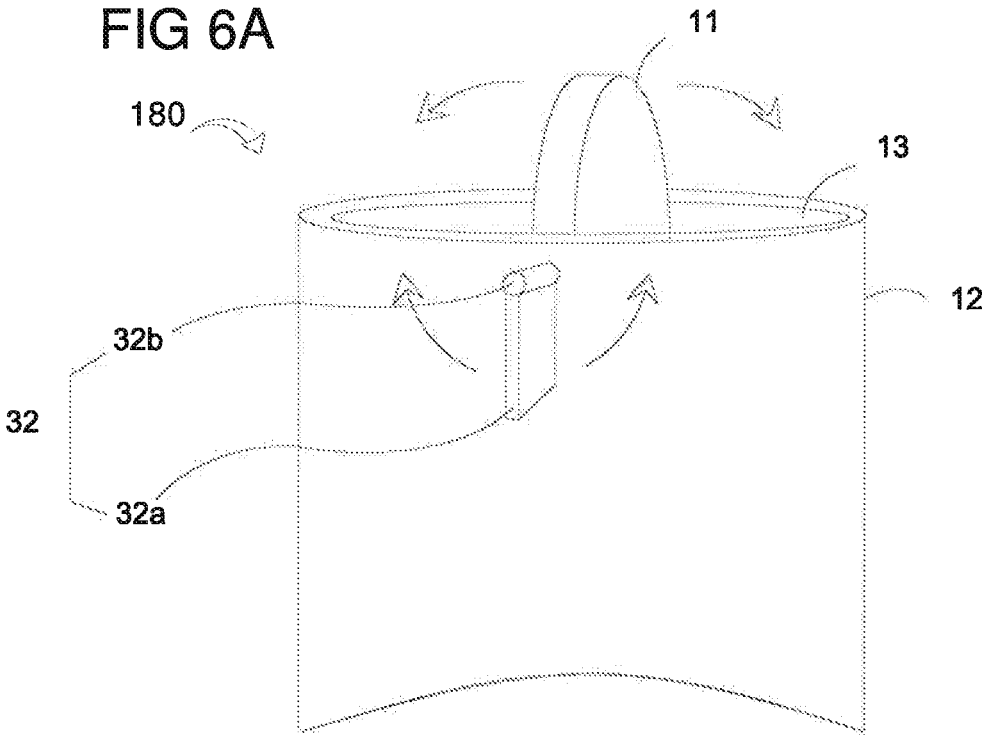
FIG. 6A is a sectional view of a system embodiment.

FIG. 6A is a perspective sectional view of a system embodiment 180 showing the mouth 13 portion of the container 12 including a stopper plate 11 provided within the mouth 13, in a non-limiting embodiment. The stopper plate 11 may be rotatable within the mouth 13 of the container 12, in one embodiment. Rotation of the stopper plate 13 may be accomplished by way of an actuator leaver 32 which may include, in a non-limiting embodiment an actuator leaver handle 32*a* and an actuator leaver projection 32*b* around which the leaver handle 32*a* may be rotated. In a further embodiment as shown in FIG. 6A, rotation of the actuator leaver handle 32*a* and the actuator leaver projection 32*b* may rotate the stopper plate 11 about a horizontal axis, such that rotation of the leaver handle and projection 32*a*, 32*b*, may cause the stopper plate 11 to move from a horizontally oriented position where it obstructs the mouth 13 of the container to a vertically oriented position wherein fluid may flow through the mouth 13 of the container around the stopper plate 11 as shown in the position of FIG. 6A.

Various other mechanisms known to one skilled in the art could be used herein to effect the same movement of components as described herein. In a further embodiment, this rotational movement of the stopper plate 11 within the mouth 13 could also be used with the embodiments wherein the stopper component 14 is moved relative to the opening 16 in the closure device 10. Actuation mechanisms such as the actuation leaver 32 described herein and other methods and mechanisms of actuation know to one skilled in the art may also be used in these non-limiting embodiments. In a further embodiment, rotation of the stopper plate 11 may move the plate vertically within the mouth 13 of the container 12, such that by rotating the stopper plate 11 in one direction, the plate is moved vertically in an upward direction toward the opening or mouth 13, and rotation in the opposite direction would move the stopper plate 11 vertically in a downward direction away from the mouth 13 of the container 12. Movement of the stopper plate 11 toward the mouth 13 may serve to obstruct the opening 13, in one non-limiting embodiment, and consequently, movement of the stopper plate 11 in the opposite direction may unobstruct the mouth 13 or opening of the container 12 and allow fluid communication there through, and vice versa. In order to obstruct the opening 16, the stopper plate 11 may fit flush within the walls of the mouth 13 portion of the container 12, in a non-limiting example. This vertical movement of the stopper plate 11 may be accomplished without rotation of the stopper plate 11 in another non-limiting embodiment.

Figure 6B:
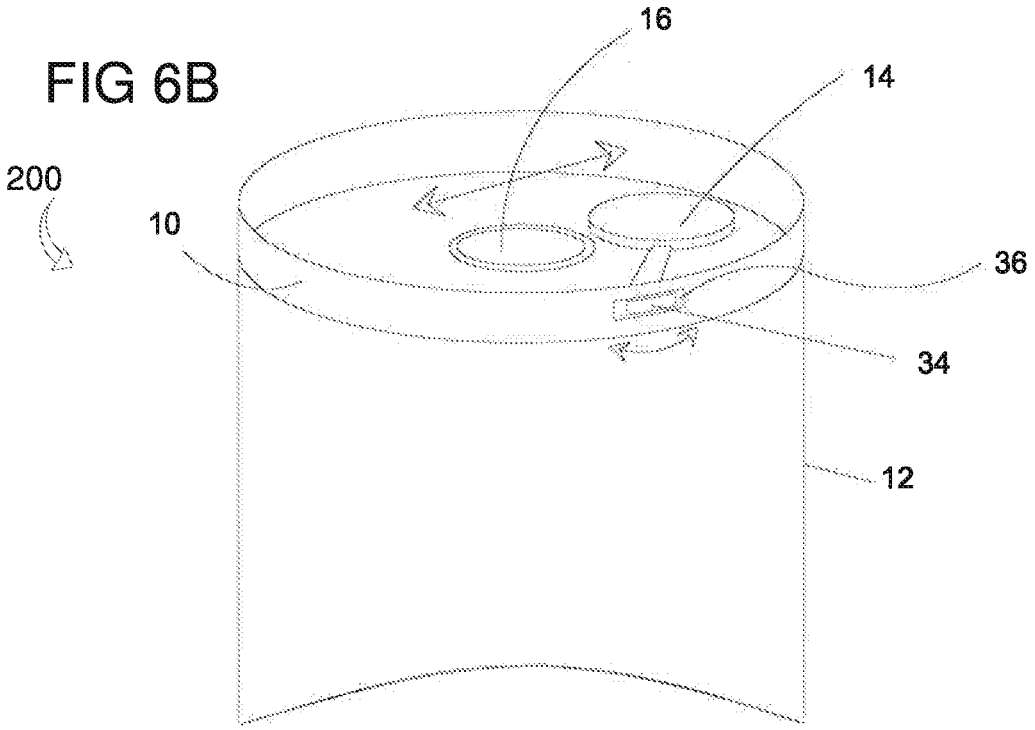
FIG. 6B is a sectional view of a system embodiment.

FIG. 6B provides a sectional view of another system embodiment 200, wherein the stopper component 14 may be configured to rotate in a plane parallel to the plane of the closure device 10, wherein rotation of the stopper component 14 may position the stopper component 14 over the opening 16 so as to obstruct the opening 16. Further rotation of the stopper component 14 in the same direction, or rotation in a direction opposite to the first rotation may displace the stopper component 14 from the opening 16 allowing fluid communication there through. This rotation may occur by way of an actuator switch 34 disposed on a component of the system as shown in the non-limiting embodiment of FIG. 6B. In this embodiment, the actuator switch 34 is disposed on an outer portion of a component of the system (shown as disposed on an outer portion of the container 12 in FIG. 6B), and the actuator switch 34 is associated with the stopper component 14. The actuation switch 34 is movable and slidable within an orifice 36 in a wall of the container 12, in one non-limiting embodiment. Consequently, movement of the actuator switch 34 results in rotation of the stopper component 14 relative to the opening 16.

Figure 7:
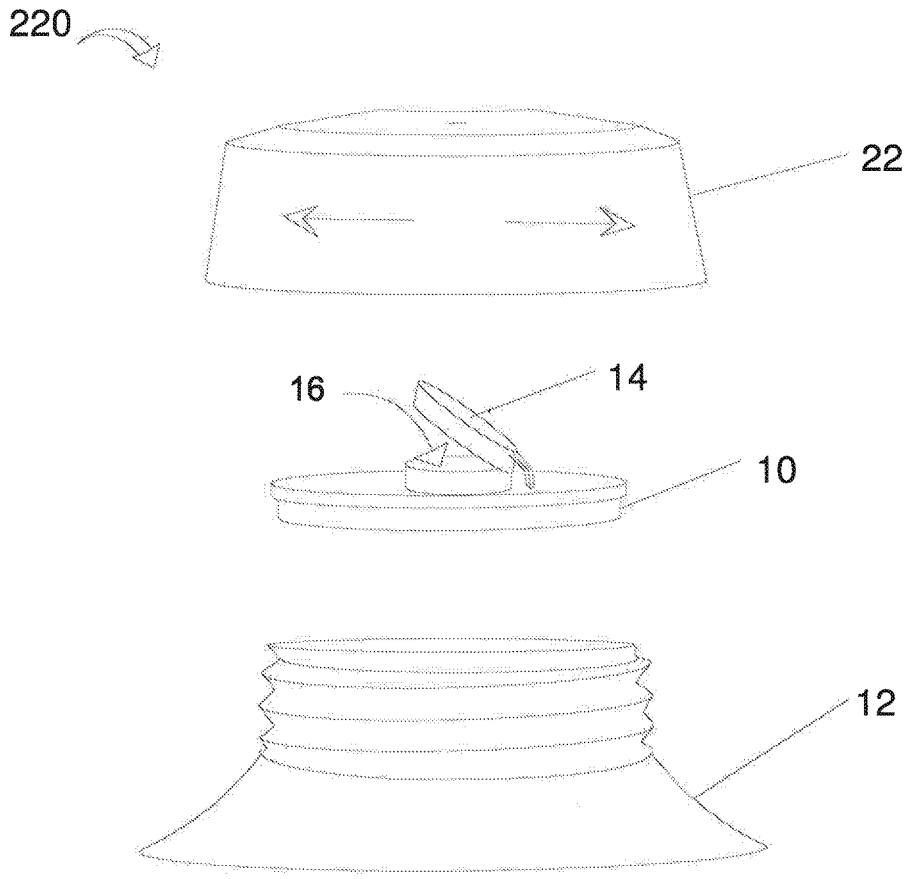
FIG. 7 is an exploded view of a system embodiment.

FIG. 7 provides a further system embodiment 220 in which rotation of the enclosure member 22 relative to the container 12 provides vertical movement of the stopper component 14 relative to the opening 16 of the closure device 10, such that rotation of the enclosure member 22 in one direction causes the stopper component 14 to obstruct the opening 16, and further rotation of the enclosure member 22 or rotation in the opposite direction releases the stopper component 14 from the opening 16 to allow fluid communication from the container 12 through the opening 16. This embodiment may be provided without an outflow component, in one non-limiting example.

Figure 8:
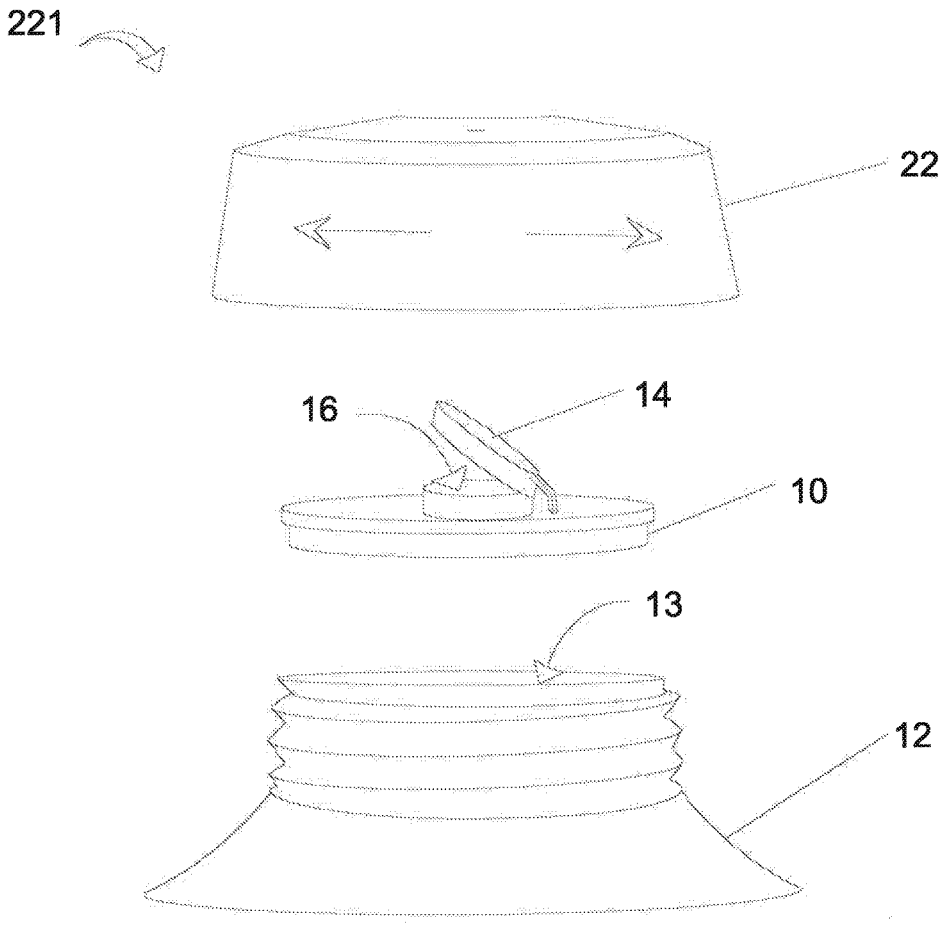
FIG. 8 is an exploded view of a system embodiment.

FIG. 8 is an exploded view of a further system embodiment 221 including the enclosure member 22, the closure device 10 with opening 16 and stopper component 14, and the container 12 having mouth 13. Placement of the enclosure member 22 over the closure device 10 disposes the stopper component 14 over the opening 16 to obstruct fluid communication there through. Removal of the enclosure member 22 releases the stopper component 14 from the opening 16 to allow fluid communication from the container 12 through the opening 16 of the closure device 10.

Figure 9:
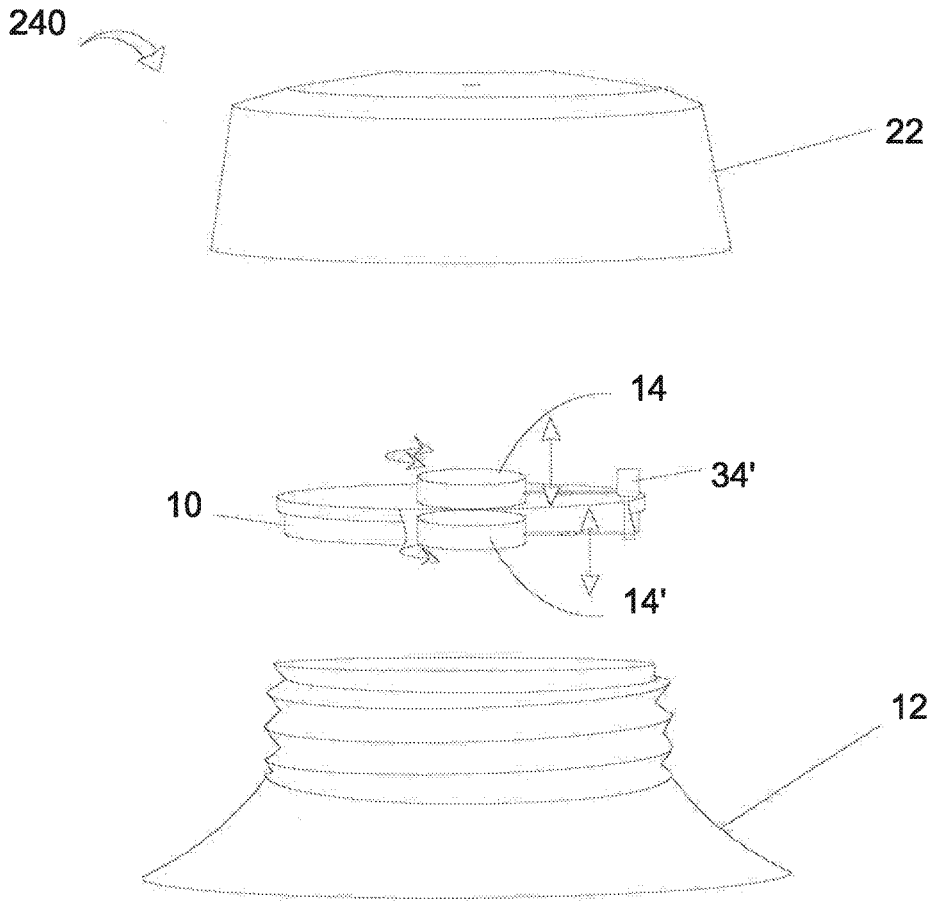
FIG. 9 is an exploded view of a system embodiment.

FIG. 9 provides a perspective exploded view of a system embodiment 240 showing a cross sectional view of the closure device 10. The system embodiment 240 includes another embodiment of an actuator switch 34' coupled to the stopper component 14, wherein movement of the actuator switch 34' effects horizontal movement of the stopper component 14 relative to the opening 16 of the closure device 10. FIG. 9 demonstrates that there may be one or more stopper components 14 in the embodiments described herein. For example, a first stopper component 14 may be placed above the closure device 10, alternatively, or in addition, a second stopper component 14' may be provided below the closure device 10. Either stopper component 14, 14' or a combination of both stopper components 14, 14' may be used to obstruct the opening 16, and may be subsequently displaced from the opening 16 to allow fluid communication from the container 12 through the opening 16 to the user. Alternatively, or in addition, movement of the actuator switch 34' may move the stopper component(s) 14, 14' vertically relative to the opening 16 of the closure device 10. The actuator switch 34' may be compressed to lower the stopper component 14 in one embodiment, and released to raise the stopper component 14, or vice versa. This compression of the actuator switch 34' may occur by placement of the enclosure member 22 over the closure device 10, in a non-limiting embodiment, and removal of the enclosure member 22 may release the actuator switch 34'. The horizontal movement of the stopper component(s) 14, 14' described above may also occur by compression and release of the actuator switch 34'.

Figure 10:
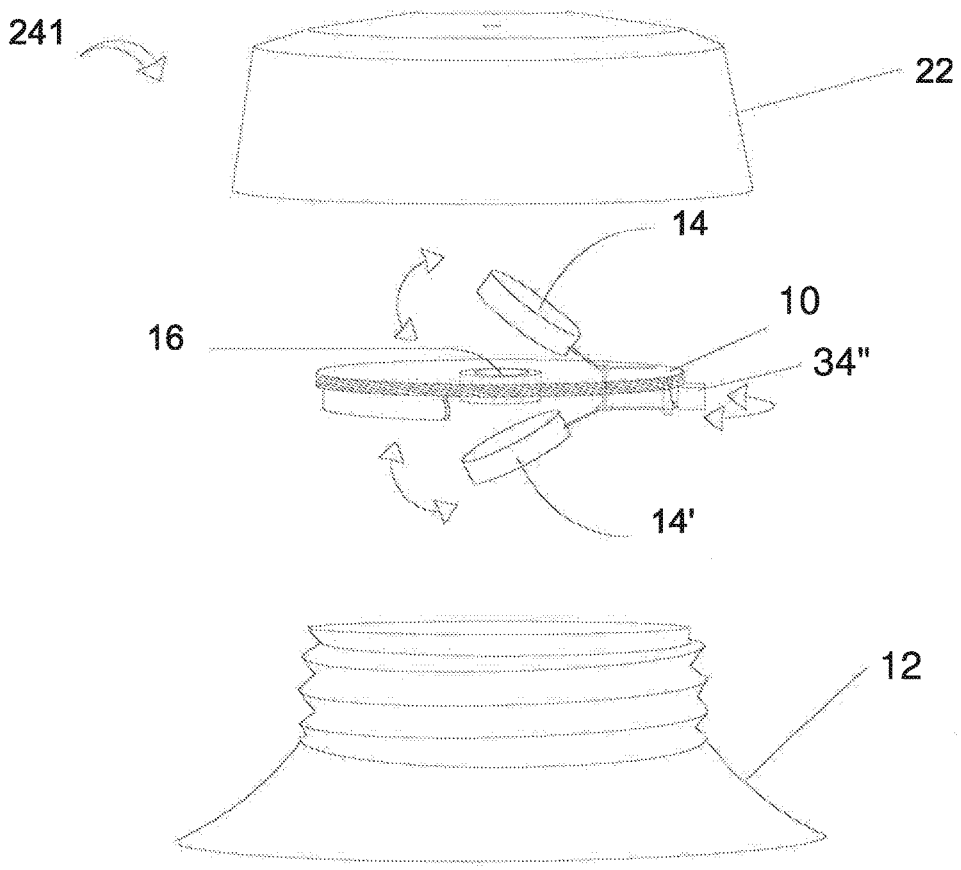
FIG. 10 is an exploded view of a system embodiment including a sectional view of a portion of a closure device.

FIG. 10 provides a perspective sectional view of a container 12 including an actuator switch 34" disposed on an outer surface thereon, in a further non-limiting system embodiment 241. The actuation switch 34" is associated with the stopper component(s) 14, 14' such that movement of the actuation switch 34" horizontally relative to the vertical axis of the container 12 moves the stopper component(s) 14, 14' in a vertical direction relative to the opening 16 in the closure device 10. This movement of the stopper component 14, 14' may be an upward vertical movement or a downward vertical movement, wherein the movement of the stopper component 14, 14' in one vertical direction serves to obstruct the opening 16 and movement in the opposite vertical direction serves to release the stopper component 14, 14' from the opening 16, allowing fluid communication there through. As mentioned above, one or more stopper components 14, 14' can be used herein. The embodiment 241 of FIG. 10 shows two stopper components 14, 14', however, either one of the stopper components 14, 14' could be used, and alternatively, both stopper components 14, 14' shown may be used, as previously described herein. One skilled in the art would appreciate that the actuation switch 34" may also, or alternatively be configured to be activated or inactivated by compressing and releasing the actuation switch 34", or vice versa, or moving the actuation switch 34" vertically, in other, non-limiting embodiments.

Figure 11:
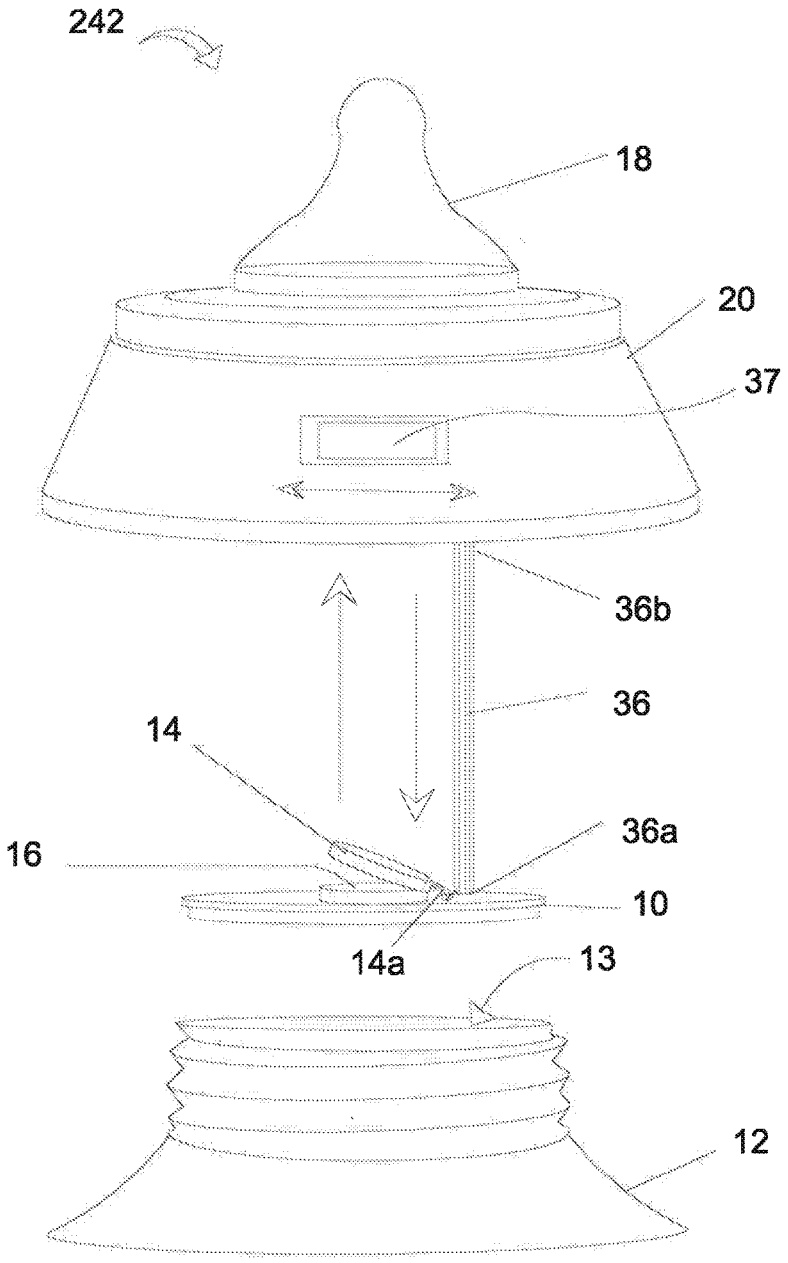
FIG. 11 is an exploded view of a system embodiment.

In the exploded sectional view of FIG. 11, a portion of a container 12 is shown as well as the outflow component 18, and the closure device 10 with the opening 16 and the stopper 14. A stopper actuator arm 36 is provided in the non-limiting system embodiment 242 shown herein. A first end **36*a* of the stopper actuator arm 36 is associated at one end with the stopper component 14, and a second end of the stopper actuator arm 36*b* is associated with a stopper arm actuator switch 37, wherein the stopper arm actuator switch 37 may be activated to move the stopper component 14 vertically or horizontally relative to the opening 16 to obstruct or unobstruct the opening 16 of the closure device 10. In a further, non-limiting embodiment, the first end 36*a* of the stopper component 14 may be associated with a stopper component member 14*a* as shown in FIG. 11, such that compression of the stopper component member 14*a* by the stopper actuator arm 36 vertically moves the stopper component 14 to allow fluid flow through the opening 16. The stopper arm actuator switch 37 is disposed in the non limiting embodiment shown herein, on an outer surface of the securing member 20. The stopper arm actuator switch 37 may be activated by pressing, rotating, or sliding the stopper arm actuator switch 37** in non-limiting embodiments.

Figure 12A:
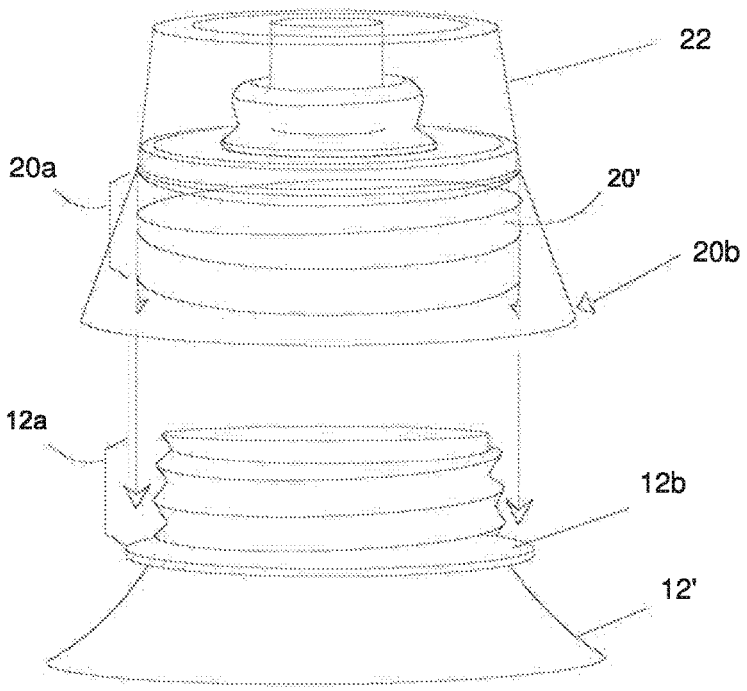
FIG. 12A is a sectional view of a portion of a system embodiment.
Figure 12B:
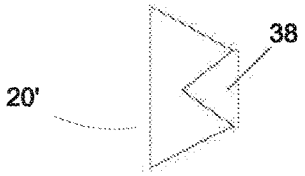
FIG. 12B-12C are sectional views of an embodiment of a component of a system.
Figure 12C:
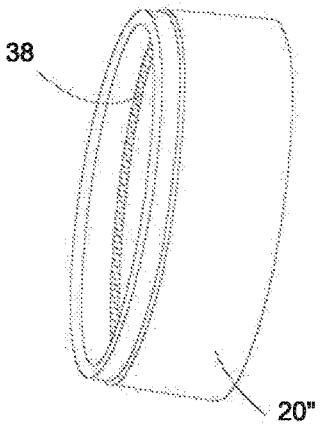

FIGS. 12A-C provide various views of embodiments of the securing member 20'. In the non-limiting embodiment of FIG. 12A, the securing member 20' includes a threaded portion **20*a* on a portion thereof. The threaded portion 20*a*** is shown on an inner surface of the securing member 20', however, the threaded portion 20*a* may also, or alternatively, be provided on an outer surface of the securing member 20'. The threaded portion 20*a* of the securing member 20' is provided for threading the securing member 20' onto a complementary threaded portion of a container 12'. The threaded container portion 12*a* may be provided on an inner surface or an outer surface of the container 12', so as to allow threading of the securing member 20' thereon. The securing member 20' may further include a clamping portion 20*b*, and the container 12' may further include a protruded portion 12*b*, wherein the protruded portion 12*b* may be provided on at least a portion of the inner or outer surface of the container 12*b*, in a non-limiting embodiment, and may be provided around the circumference of the container 12' as shown in FIG. 12, for example. Upon threading of the securing member 20' onto the container 12, the clamping portion 20*b* would engage the protruded portion 12*b* of the container 12' to effectively lock the securing member onto the container, in non-limiting embodiments. This would effectively prevent the securing member from being removed from the container 12' with reasonable force. This embodiment would provide a one-time use system, which could be disposed of or recycled after use. Those skilled in the art would appreciate that the clamping portion may be provided on the container 12' and the protruded portion may be provided on the securing member 20' in non-limiting alternative embodiments.

In further non-limiting embodiments as shown in FIGS. 12B and 12C, the securing member 20" may include one or more gripping devices 38 provided on a surface thereof, wherein the gripping devices 38 would serve to affix the securing member 20" to the container 12. While the gripping devices 38 are shown in FIGS. 12B and 12C as disposed on an inner surface of the securing member 20", they may alternatively or in addition be provided on an outer surface of the securing member 20". One skilled in the art would understand that the gripping devices 38 may alternatively or additionally be provided on the portion of the container 12 configured to contact the securing member 20, 20" to provide a secure connection there between when the securing member 20, 20" is attached to the container 12. Additionally, food-grade glue or other adhesives known to those skilled in the art could be applied to or disposed between the securing member 20, 20', 20" and the container 12, 12' to provide a more secure, a semi-permanent, or a permanent connection there between. The adhesive or glue could be applied between the gripping devices 38, in a non-limiting example.

Figure 13:
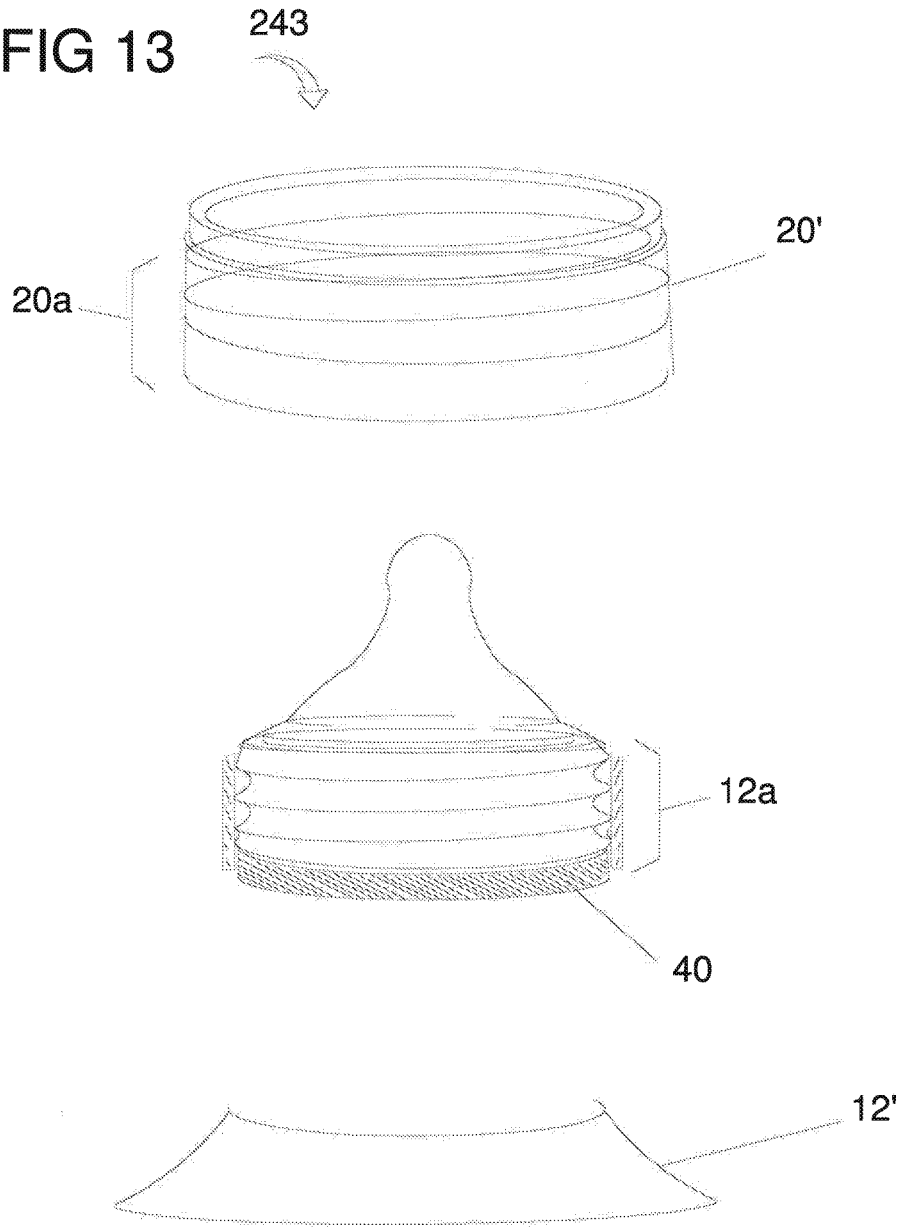
FIG. 13 is an exploded view of a system embodiment.

The exploded views of FIG. 13 provide an example of an embodiment 243 which include an adhesive 40 which can be disposed between the threaded securing member 20' and the threaded container 12'. The adhesive 40 may provide permanent, semi permanent, or temporary attachment between the securing member 20' and the container 12'. In the embodiment shown in FIG. 13, the adhesive 40 would provide further attachment between the securing member 20' and the container 12' in addition to the attachment provided by the threaded portions 20*a*, 12*a*. The adhesive 40 described herein may be used on an embodiment with no threaded portions on the securing member or the container, in an alternative embodiment.

Figure 14:
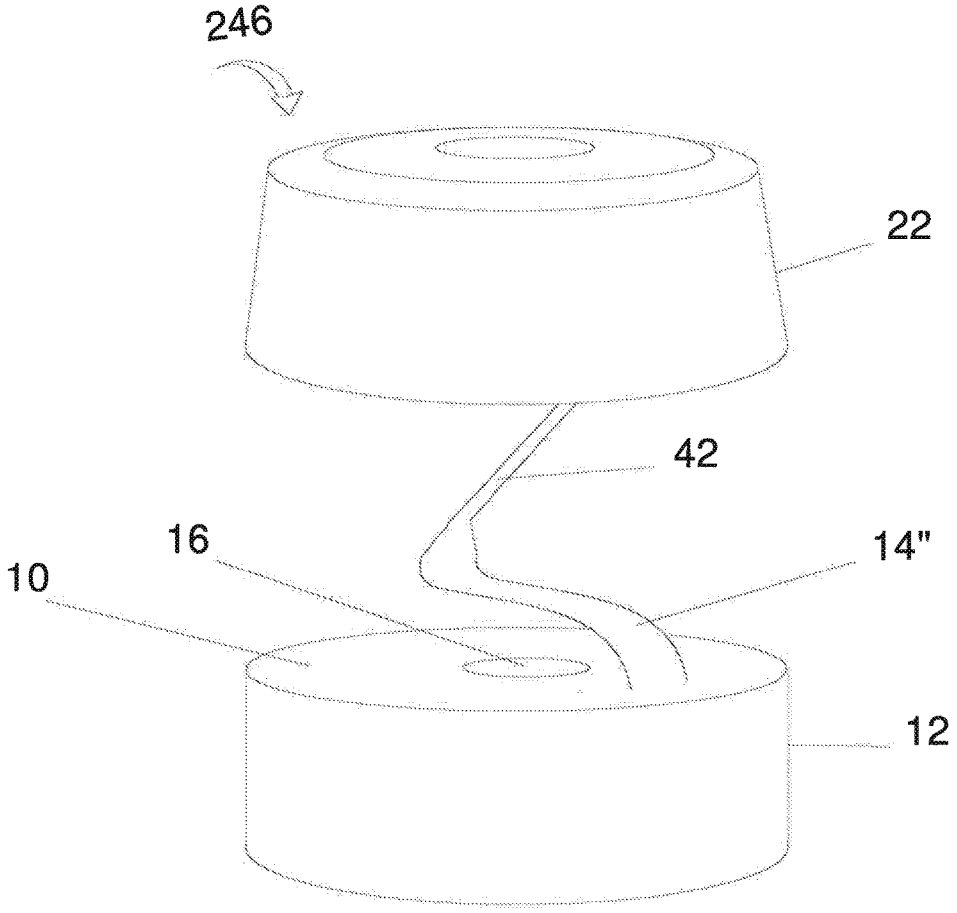
FIG. 14 is an exploded view of a further system embodiment.

In a further system embodiment 246 shown in FIG. 14, the enclosure device 22 or the securing member 20 in non-limiting embodiments, may include an actuation device 42 associated therewith. The actuation device 42 may also be associated with the stopper component 14", wherein the stopper component 14" may be an adhesive, or a seal, in non-limiting embodiments. The stopper component 14" may further include a material, which may be a flexible material in some non-limiting embodiments, which can be disposed over or affixed to the closure device such that it can obstruct the opening 16. Removal of the enclosure device 22 or the securing member 20 which is affixed to the actuation device 42 would remove the stopper component 14" from the opening 16 to allow fluid communication there through.

Figure 15:
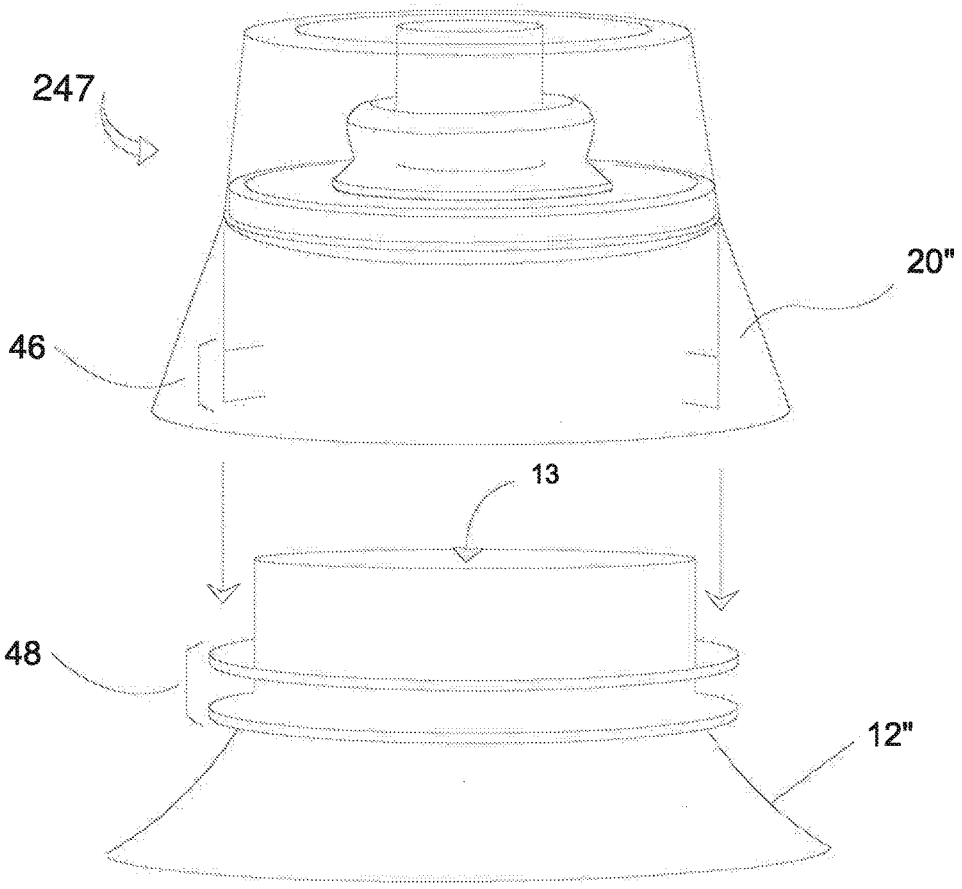
FIG. 15 is a sectional view of a system embodiment.

FIG. 15 provides a further embodiment 247 of a securing member 20" in which a portion of the securing member 20" may include one or more latch rings 46 which correspond to and engage with corresponding latch rings 48 on the container 12", such that when the securing member 20" is pressed onto the container 12", the latch rings 46 engage the latch rings 48 of the container to provide a secure connection there between. The secure connection will prevent the securing member 20" from being removed from the container 12" with reasonable force.

Figure 16:
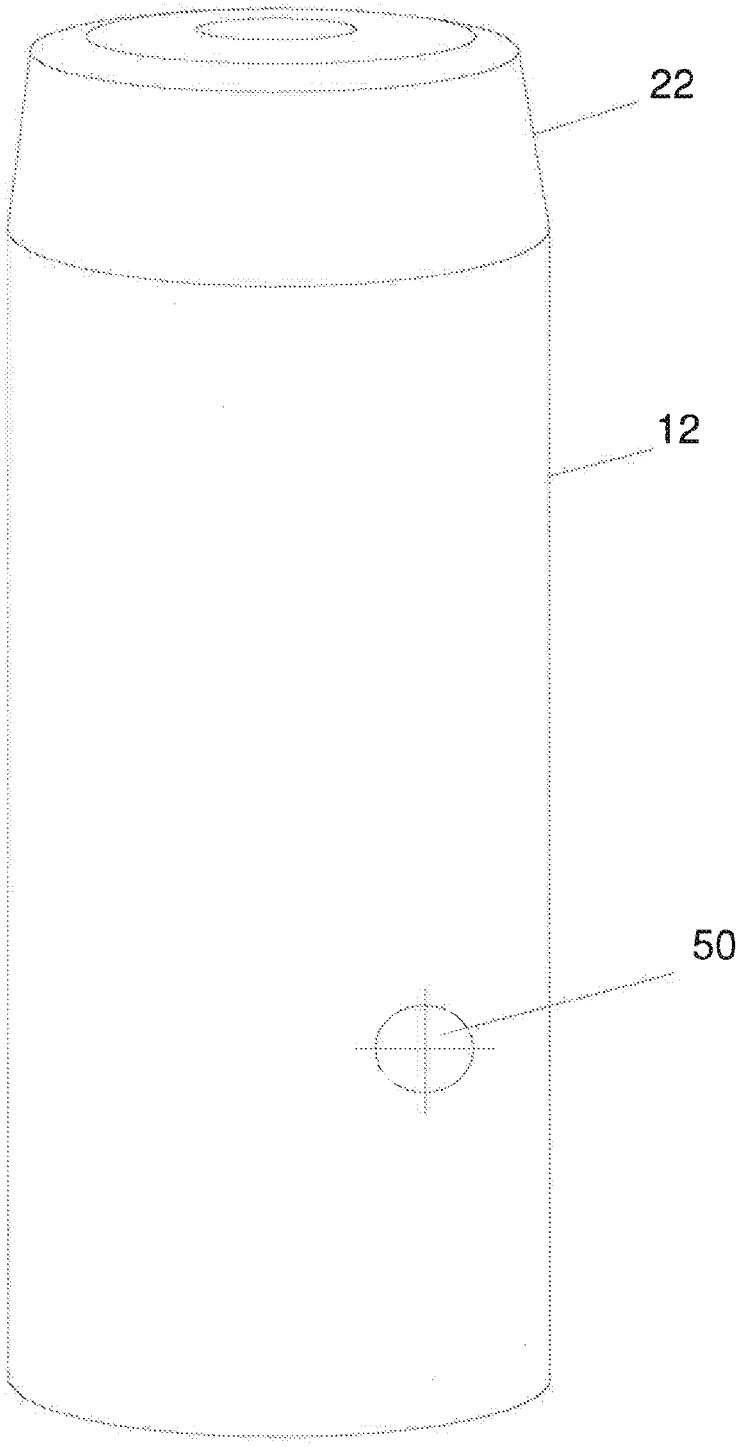
FIG. 16. is a perspective view of a container embodiment.

FIG. 16 shows a perspective view of a container 12 with an optional air inlet valve device 50 provided on the container 12 housing. The air inlet valve device 50 allows air to flow into the container 12, but will prevent air or fluid from flowing out of the container 12. The air inlet valve device 50 will relieve the vacuum inside the container 12 when the product is being removed from the container 12.

Figure 17:
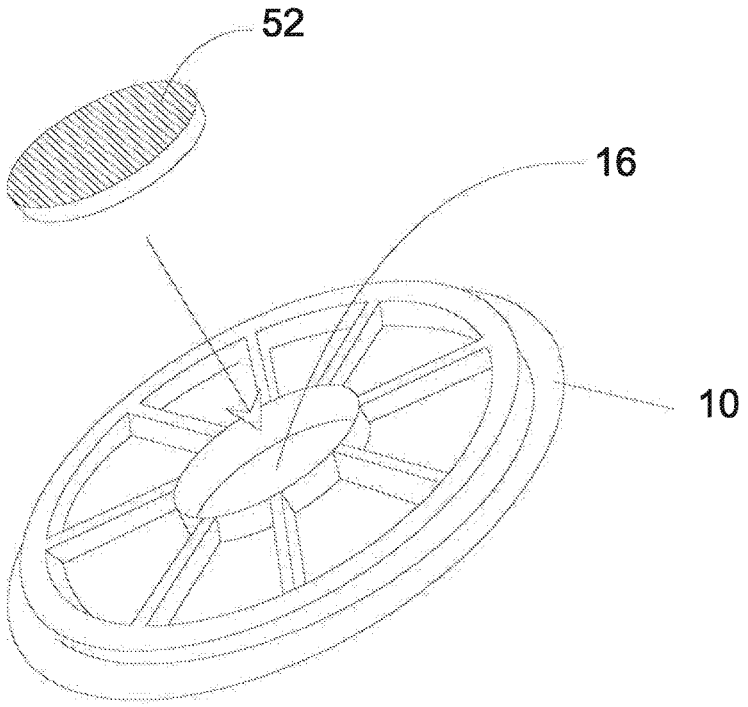
FIG. 17 is an exploded view of a closure device embodiment.

FIG. 17 provides a view of an embodiment of a screen 52 or filter that may be disposed within the opening 16 of the closure device 10. The screen 52 may prevent clumps of product from clogging the hole of the closure device 10.

Figure 18:
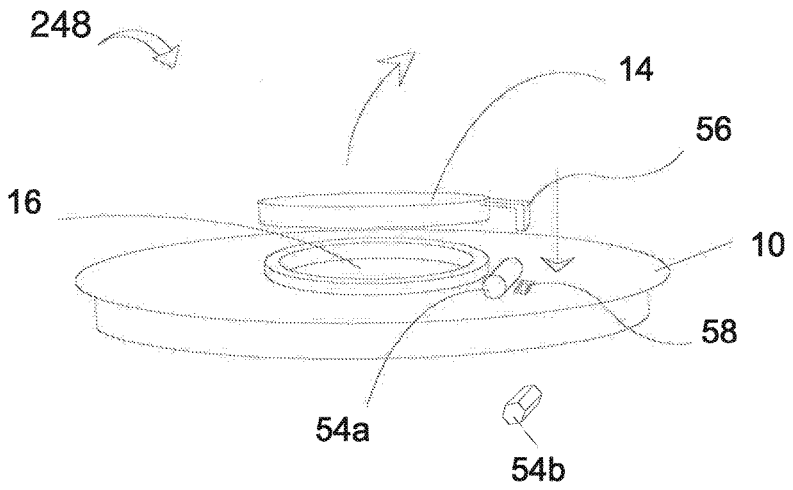
FIG. 18 is an exploded view of a system embodiment.
Figure 19:
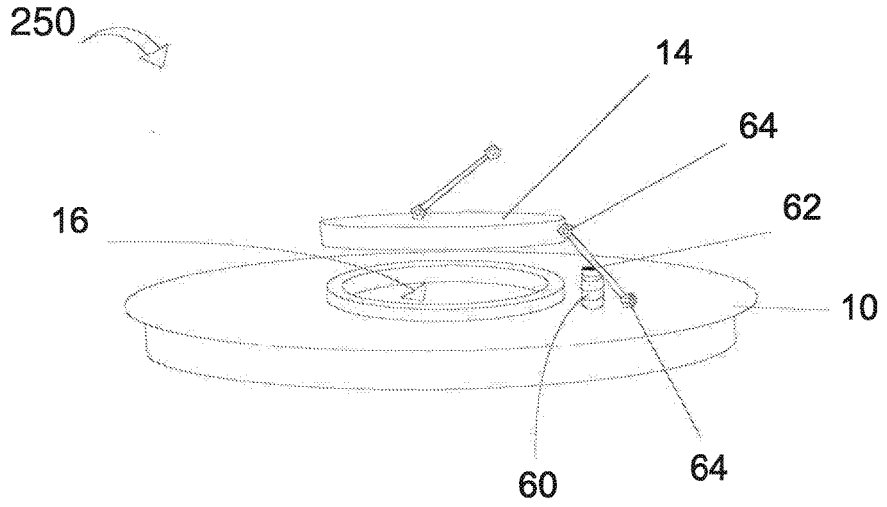
FIG. 19 is a perspective view of an embodiment of a closure device.

The system embodiment 248 shown in FIG. 18 provides an embodiment of an actuation member, wherein said actuation member is a solid element 54*a*, 54*b*, which can be provided under a portion or all of the outside radius of the stopper component 14 or a stopper mounting device 56 which connects to the stopper component 14 to allow the stopper component 14 to be moved vertically relative to the opening 16 of the closure device 10 as the stopper mounting device 56 moves over the solid element 54*a* or 54*b*. The stopper mounting device 56 may be placed within a mounting opening 58 in the closure device 10, in a non-limiting embodiment. The stopper mounting device 56 may alternatively be mounted on or inside or molded into the closure device 10 in further non-limiting embodiments. In a non-limiting embodiment, the embodiment 248 may be provided with an enclosure member 22, wherein upon removal of the enclosure member 22, the solid element 54*a*, 54*b* causes the stopper component 14 to be displaced vertically from the opening 16. In one embodiment, this may break a seal that is formed between the stopper component 14 and the closure device 10 to allow fluid communication through the opening 16. FIG. 19 provides an embodiment 250 of a system providing a view of the closure device 10, with a stopper component 14, wherein the stopper component 14 is moved relative to the opening 16 by way of an actuator arm device 62. The actuator arm device may contact the stopper component 14 by way of a mechanical swivel 64, and may further attach to the closure device 10 with a mechanical swivel 64 in a non-limiting embodiment. An actuator spring mechanism 60 is also shown in FIG. 19, wherein the actuator spring mechanism 60 may affect movement of the stopper component 14 by moving the actuator arm device 62. An elastic mechanism may be used in place of the spring mechanism 60 to displace the stopper component 14 from the opening 16. The system embodiment 250 of FIG. 19 may provide vertical and/or horizontal movement of the stopper component 14 relative to the opening 16.

Figure 20:
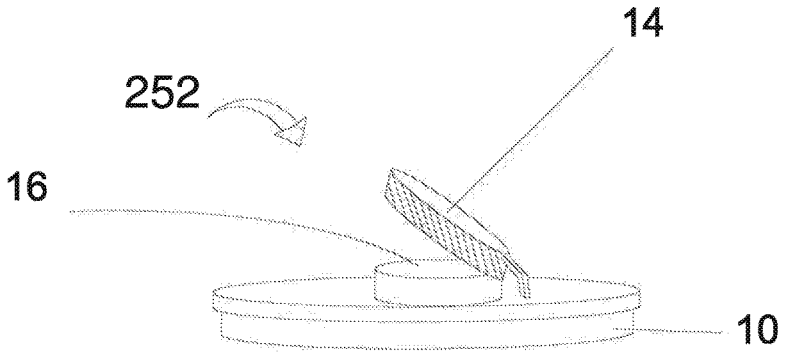
FIG. 20 is a perspective view of another embodiment of a closure device.

FIG. 20 provides a view of the closure device 10, with a non-limiting system embodiment 252 including a stopper component 14, wherein the stopper component 14 may be made of a material which would allow the stopper component 14 to move freely within the opening 16 of the closure device 10. For example, the stopper component 14 may be hollow, in a non-limiting embodiment, which may allow it to float like a fishing bobber within the opening 16, therefore allowing fluid communication there through when the stopper component 14 is displaced from the opening, as when a user dispenses product from the container, displacing the stopper component 14 from the opening 16.

Figure 21:
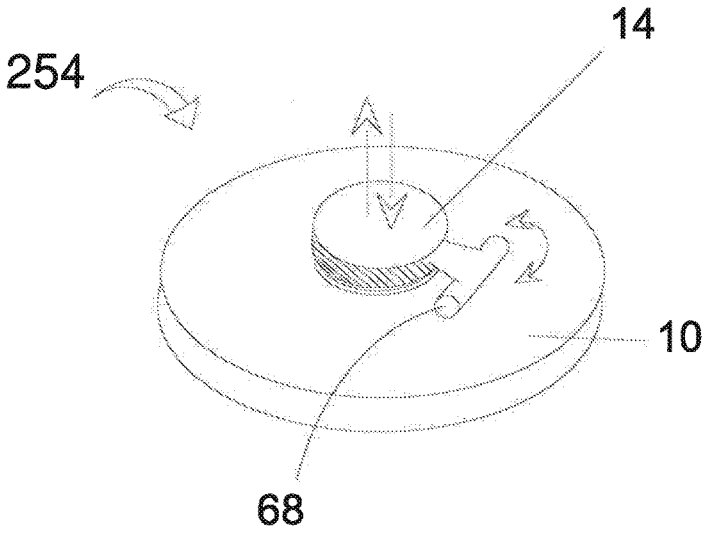
FIG. 21 is a perspective view of another embodiment of a closure device.

In the system embodiment 254 shown in FIG. 21, the stopper component 14 may be affixed to the closure device 10 with a free flowing hedge device 68 allowing the stopper component 14 to open or close and allow or prevent fluid communication through the opening 16 in the closure device 10. The stopper component 14 and opening may include foil, metal, plastic or other materials conducive to food grade materials in non limiting embodiments, which can provide an air tight or liquid tight seal between the container 12 and the securing member 20.

Figure 22:
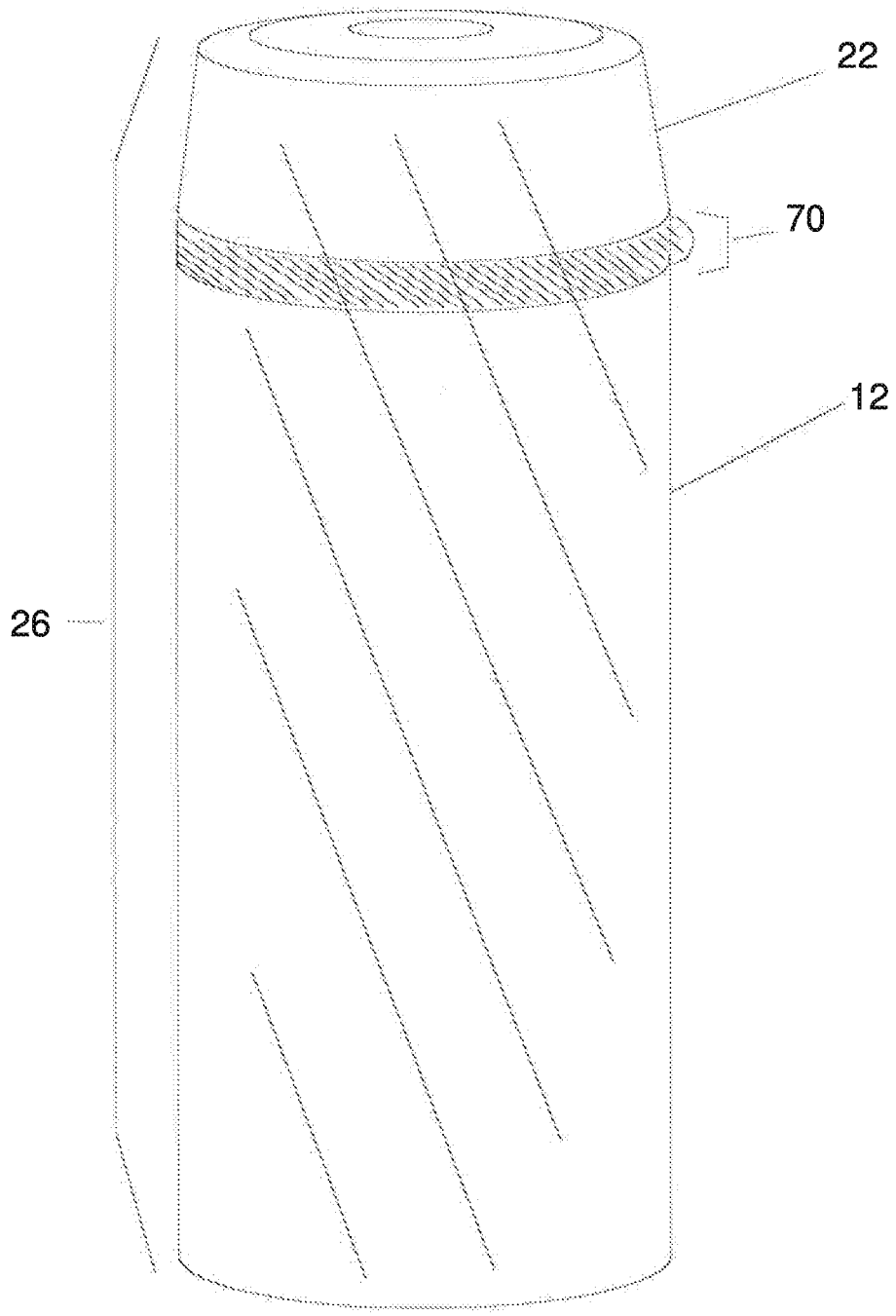
FIG. 22 is a perspective view of an embodiment of a container.

FIG. 22 provides an embodiment including a removable safety zipper device 70 that can be used to seal the securing member 20 and the container 12 together, in a non-limiting embodiment. A protective cover 26 may also, or alternatively, be used to cover over the container 12 or a portion thereof. The safety zipper device 70 and the protective cover 26 must be removed before product can be delivered to the user from the container 12.

Figure 23:
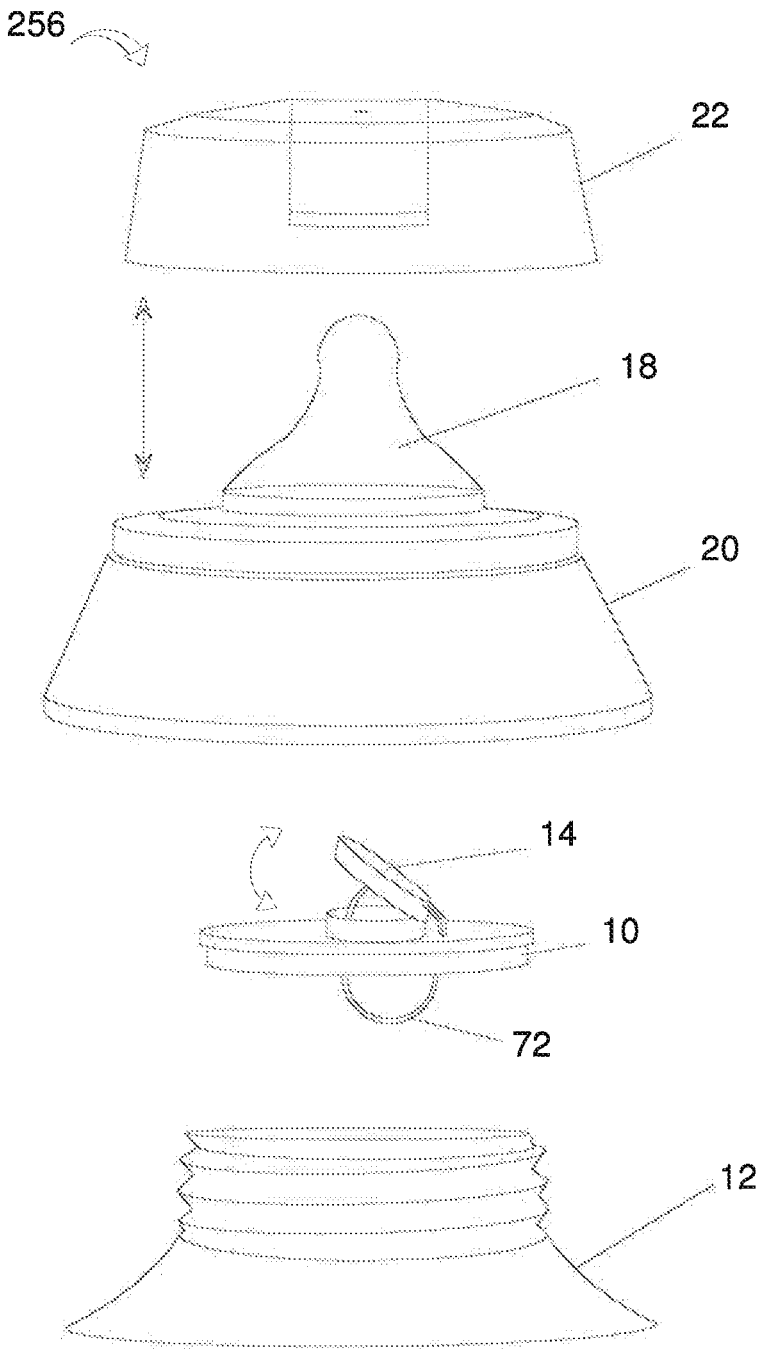
FIG. 23 is an exploded view of a system embodiment.

FIG. 23 provides an exploded view of a system embodiment 256 which shows the outflow component 18 associated with the securing member, and a portion of the container 12. The embodiment 256 includes a stopper component 14 associated to a springing device 72, which is connected to a lower surface of the stopper component 14 through the opening 16 and to a lower surface of the closure device 10. The springing device 72 provides a force on the lower surface of the stopper component 14 pressing the stopper component 14 toward the outflow component 18. When the outflow component is in a folded position, it compresses the stopper component 14 preventing fluid communication through the opening 16 in the closure device 10. However, when the outflow component 18 is in a relaxed, unfolded position, the downward pressure on the stopper component 14 is removed and the upward pressure on the stopper component by the springing device 72 serves to displace the stopper component 14 from the opening 16 allowing a fluid communication through the opening 16 to deliver product within the container 12 through the closure device 10 and the outflow component 18 to a user.

Figure 24A:
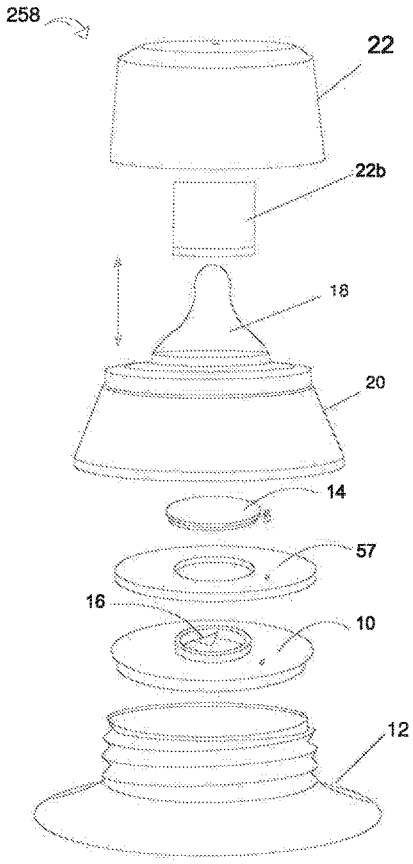
FIG. 24A is an exploded view of a system embodiment.
Figure 24B:
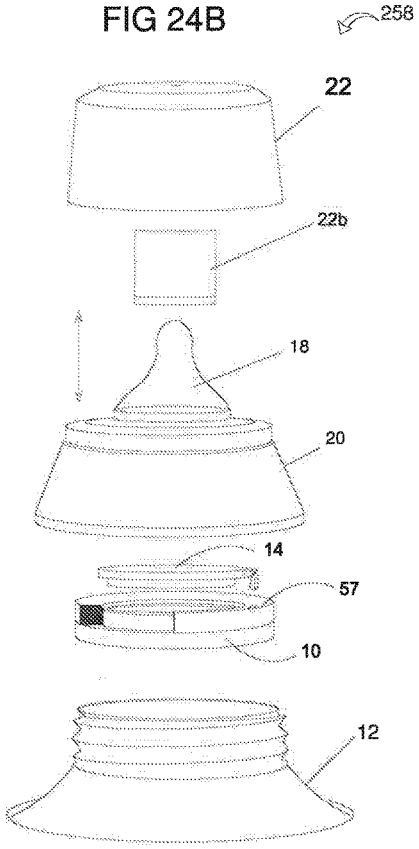
FIG. 24B is a further exploded view of the system embodiment of FIG. 24A.

FIGS. 24A and 24B are exploded and partial sectional views of an embodiment, 258 in which a spacer 57 is disposed between the closure device 10 and the stopper component 14. The spacer 57 may include a cylindrical shape or a partial cylindrical shape, in non-limiting embodiments. When the enclosure member 22 compressed over the closure device 10, protrusion member 22*b* compresses the stopper component 14 over the spacer 57, such that the spacer 57 is compressed preventing fluid communication through the opening 16, and in some non-limiting embodiments, maintaining an air tight and fluid tight seal 57 between the stopper component 14 and the closure device 10. Removing the enclosure member 22 releases the protrusion member 22*b* from the stopper component 14, resulting in release of the pressure on the spacer 57, allowing the spacer 57 to expand, in a non-limiting embodiment, to break the seal between the stopper component 14 within the opening 16 to allow fluid communication there through. FIG. 24B further provides a sectional view of the spacer 57.

As described above in one embodiment, a system configured to be mounted on a container for storing and dispensing a product is provided. The system may include a closure device configured to be disposed over a mouth portion of the container, the closure device including an opening for providing fluid communication between the container and a user, an outflow component including an upper portion and a base, and configured to be in a folded position when not in use and an unfolded position to dispense the product to the user, the upper portion of said outflow component comprising an outflow aperture to provide a fluid communication between the outflow component and the user, a securing member for supporting the outflow component in a position over the closure device, the securing member configured to receive the outflow component when said outflow component is in the folded position, and an enclosure member configured to be removably engageable with the securing member, wherein when the enclosure member is engaged with the securing member, the outflow component is compressed into a folded position, wherein at least a portion of the base of the outflow component obstructs the opening of the closure member during storage of the product, wherein when the enclosure member is disengaged from the securing member, the outflow component is released into the unfolded position, providing fluid communication through the opening of the closure device to dispense the product to the user.

In a further embodiment the system is provided wherein when the outflow component is in a folded position, a seal is formed between the base of the outflow component and the closure device to obstruct the opening and prevent fluid flow there through.

In still a further embodiment, the system is provided wherein the closure device includes a stopper component configured to obstruct the opening during storage of the product and configured to be displaced from the opening to provide fluid communication through the opening during dispensing of the product.

In yet a further embodiment, when the outflow component is in the folded position, the outflow component depresses the stopper component to obstruct the opening of the closure device to prevent fluid flow through the opening, wherein when the outflow component is in an unfolded position, the stopper component is displaced from the opening allowing a flow of fluid there through.

In a further embodiment, the system may include an enclosure member projection extending from the securing member, wherein said enclosure member projection depresses the stopper component into the opening upon engagement of the enclosure member over the outflow component, wherein when said enclosure member is released from the outflow component, the enclosure member projection is released from the stopper component, and the stopper component is displaced from the opening.

In another embodiment, a system including a closure device, the closure device including an opening for providing fluid communication there through, an outflow component configured to be disposed over the closure device, the outflow component including an outflow aperture to provide fluid communication between the outflow component and a user, a securing member for supporting the outflow component in a position over the closure device is provided. The system further includes a stopper component removably engageable with said opening of said closure device, wherein when the stopper component is engaged with the opening, the stopper component obstructs the opening preventing a flow of fluid through the opening, and wherein displacement of said stopper component from the opening allows fluid communication through the opening.

In a further embodiment, the system may further include a trigger switch connected to a triggering element, wherein the trigger switch may be disposed on a component of the system in a non-limiting embodiment. The triggering element may be disposed over the stopper component, wherein when the trigger switch is compressed and released, the triggering element is raised and lowered, such that the stopper component is raised and lowered over the opening.

In yet a further embodiment, the system may be provided wherein the stopper component is configured to rotate in a plane parallel to the plane of closure device. The stopper component may be attached to an actuator switch, the actuator switch may be disposed on an outer portion of a component of the system and may be slidable within an orifice in the component of the system, wherein movement of the actuator switch rotates the stopper component from a first position in which the stopper component obstructs the opening of the closure device, to a second position in which the stopper component is displaced from the opening.

In another non-limiting embodiment, the stopper component may be associated with a stopper actuator arm. The stopper actuator arm may be associated with a stopper arm actuator switch which may be disposed or positioned on an outer portion of a component of the system, wherein when said stopper arm actuator switch is activated, the stopper arm moves said stopper component in a vertical direction relative to the opening.

In another embodiment, the system may further include an actuator switch disposed on the securing member or the closure device, the actuator switch configured to vertically move the stopper component relative to the opening when activated.

In another embodiment, the system may further include a container, wherein the container may include a mouth portion having an opening and a cavity configured to house a product deliverable to a user. The closure device may be associated with the mouth portion of the container, wherein the product is deliverable to the user through the outflow component of the system when the stopper component is displaced from the opening of the closure device.

In still another embodiment, the system may further include an enclosure member, the enclosure member may be removably engageable over the outflow component.

The securing member may further include a threaded portion and a clamping portion, and at least a portion of the container may include a complementary threaded portion and a protruded portion, such that the securing member is threadable onto the container and the clamping portion of the securing member may engage the protruded portion of the container. In another embodiment, the securing member may include a threaded portion only and the portion of the container to be attached thereto, may only include a complementary threaded portion, such that the securing member can be threaded onto the container. The surfaces of the securing member and the portion of the container which associate or interconnect with one another may include gripping portions in an alternative embodiment, wherein the contact between the components is secured by a gripping force between the two components. In a further embodiment, a type of adhesive or food-grade glue may be provided to further secure the components (i.e., the securing member and the container) together as shown in FIG. 12.

In an alternative embodiment, the securing member may include a threaded portion and a protruded portion, and at least a portion of the container may include a complementary threaded portion and a clamping portion, such that the securing member is threadable onto the container and the clamping portion of the container engages the protruded portion of the securing member. In a further embodiment, the securing member may be affixed to the container with an adhesive. The adhesive may include, in non-limiting embodiments, one or more of: a glue, a food-grade adhesive or food-grade glue, a tape, or other type of adhesive known to one skilled in the art.

In a further embodiment, the securing member may include a threaded portion and an adhesive disposed at a lower portion thereof, and at least a portion of the container may include a complementary threaded portion, wherein the securing member can be threaded onto the container, and the adhesive can further affix the securing member to the container.

In another non-limiting embodiment, the stopper component may include an adhesive as shown in FIG. 14, wherein the adhesive may be associated with an actuation device, and wherein the actuation device is associated with the outflow component or the securing member, such that when the outflow component or securing member associated with the actuation device is removed, the adhesive is removed from the opening allowing fluid communication there through.

In yet a further embodiment, the stopper component may be associated with a stopper mounting device, the stopper mounting device may be affixed to the closure device, wherein an actuation member is disposed beneath the stopper mounting device, the actuation member configured to vertically and/or horizontally displace the stopper component from the opening to allow a flow of fluid there through. The stopper mounting devices include, but are not limited to a solid device 56 as shown in FIG. 18, a mechanical swivel device 64 as provided in FIG. 19, or a free flowing hedge device 68 as shown in FIG. 21.

In a further embodiment, the system may be provided wherein the actuation member includes a spring mechanism 60 as shown in FIG. 19. The spring mechanism may be configured to be expanded or contracted to vertically displace the stopper component from the opening. Various types of spring mechanisms may be included such as a torsion spring, a tension/extension spring, a compression spring, in non-limiting examples.

In a further embodiment, the actuation member may further include a solid element such as the non-limiting solid element examples shown in FIG. 18, (54*a*, 54*b*), the solid element being rotatable to vertically displace the stopper component from the opening.

In another embodiment, the stopper component is associated with a stopper mounting device as shown in FIG. 23. The stopper mounting device 72 may include a first end and a second end, wherein the first end is affixed to a lower surface of the closure device and the second end is affixed to a lower surface of the stopper component, the stopper mounting device extending through the opening of the closure device and exerting a pressure onto the lower surface of the stopper component, wherein when a pressure is exerted onto an upper surface of the stopper component, the stopper component is engaged in the opening of the closure device. When the pressure is released from the upper surface of the stopper component, the stopper mounting device displaces the stopper component from the opening of the closure device providing a fluid communication there through.

In another embodiment, a container is provided. The container may include a housing for storing and delivering a product to a user, the housing having an opening for providing a fluid communication between the housing and a user. The container may also include an outflow component. In some, non-limiting embodiments, the outflow component may include a resilient material. The outflow component may include a upper portion, a base, and an outflow aperture, wherein the outflow aperture is configured to provide a fluid communication between the outflow component and the user, the outflow component configured to be disposed over the opening in the housing, and an enclosure member may be configured to be removably coupled to the housing, wherein when the enclosure member is disposed over the outflow component, the outflow component is compressed into a folded position such that at least a portion of the base of the outflow component obstructs the opening of the closure member during storage of the product, and wherein when the enclosure member is displaced from the outflow component, the outflow component is released into the unfolded position, providing fluid communication through the opening of the housing such that the product can be delivered to the user.

In a further embodiment, when the outflow component is in a folded position, the base of the outflow component forms a seal with the housing to obstruct the opening and prevent fluid communication there through.

In a further embodiment, the container may further include a stopper component, the stopper component may be configured to obstruct the opening of the housing during storage of the product and may be configured to be displaced from the opening to provide fluid communication through the opening during dispensing of the product, such that when the outflow component is in a folded position, the stopper component obstructs the opening, and when the outflow component is released, the stopper component is displaced from the opening.

In another embodiment, a closure device configured to associate with a mouth of a container for storing and dispensing a product is provided. The closure device may include an upper surface and a lower surface, wherein the lower surface is in communication with the container, an opening, the opening providing a fluid communication from the container through the closure device for dispensing the product from the container, a stopper component, the stopper component may be configured to obstruct the opening of the closure device when the stopper component is in an active position, and the stopper component may be configured to move above the horizontal plane of the closure device to allow the product to be dispensed from the container through the opening when the stopper component is in an inactive position.

Regarding embodiments of the stopper component as described herein, a portion of the stopper component may traverse a portion of the opening to obstruct the opening. In another embodiment, the stopper component may cover over the opening. The stopper component, or a portion thereof may be shaped so as to fit within the opening, either partially or wholly, in non-limiting embodiments.

In a further embodiment, the container may include an outflow component, the outflow component may include an outflow aperture for delivering the product from the container to a user, the outflow component may be removably affixed to the closure device with a securing member.

In still a further non-limiting embodiment, the outflow component may include a resilient material, the outflow component may be collapsible within the securing member, wherein when the outflow component is collapsed within the securing member, at least a portion of the outflow component at least partially compresses the stopper component, such that the stopper component at least partially obstructs the opening preventing a fluid flow there through.

The stopper component may biased toward the outflow component in a non-limiting example, wherein when the outflow component is released, the stopper component is at least partially vertically (and/or in some embodiments horizontally) displaced from the opening of the closure device to allow access to the opening providing fluid flow there through.

In a further embodiment, the container may include an enclosure member, the enclosure member being engageable over the outflow component. When the enclosure member is engaged over the outflow component, the enclosure member compresses the outflow component to collapse the outflow component into the securing member to prevent fluid flow through the opening, wherein when the enclosure member disengaged from the outflow component, the outflow component is released from the securing member, releasing the stopper component from the opening to allow fluid flow through the opening into the outflow component, in a non-limiting embodiment.

In a further non-limiting embodiment, the enclosure member may include a protrusion member, the protrusion member may extend from an inner surface of the enclosure member. The protrusion member may include a protrusion member head at a distal end of the protrusion member, the protrusion member head being configured to associate with the outflow component aperture to obstruct the aperture and/or remove debris from the aperture when the enclosure member is engaged with the outflow component.

In still another embodiment, the enclosure member may further include an enclosure member projection extending from the enclosure member, the enclosure member projection may be configured to compress the stopper component such that the stopper component is placed over the opening to prevent fluid communication there through.

In another embodiment, the stopper component may be further associated with an actuator mechanism, wherein the stopper component is configured to rotate over the opening in a plane transverse to the longitudinal axis of the container, wherein the rotation is relative to the movement of the actuator mechanism.

In still a further embodiment, the closure device 10 further includes an enclosure member 22 configured to engage with the closure device 10, the enclosure member 22 including a protrusion member **22*b*, wherein the protrusion member 22*b* extends from an inner surface of the enclosure member 22. The protrusion member 22*b* is configured to compress the stopper component 14 toward the opening 16 when the enclosure member 22 is engaged with the closure device 10. In yet a further embodiment, the closure device 10 further includes a spacer 57 disposed between the closure device 10 and the stopper component 14, such that when the enclosure member 22 is engaged with the closure device 10, the protrusion member 22*b* compresses the stopper component 14 and the spacer 57 forming a seal between the stopper component 14 and the closure device opening 16, wherein when the enclosure member 22 is disengaged for the closure device 10, the spacer 57 expands allowing fluid communication through the opening 16. In a non-limiting embodiment, the spacer 57** may include an expandable and compressible material, such that when pressure is applied thereto, it is compressed, and when the pressure is released there from, it expands.

In a non-limiting embodiment provided herein, the container and/or system, when in completed form may come from the factory having all components completely assembled and including a nutrient source or other product contained therein. In these non-limiting embodiments, the container and/or system may be completely sealed, air tight and bacteria free, and may be provided for one-time use only, for example.

It will nevertheless be understood that no limitation of the scope of embodiments of the invention is thereby intended, such alterations and further modifications in the illustrated device, and such further applications of the principles of the invention as illustrated herein being contemplated as would normally occur to those skilled in the art to which the invention pertains. While a number of embodiments of the present invention have been shown and described herein in the present context, such embodiments are provided by way of example only, and not of limitation. Numerous variations, changes and substitutions will occur to those of skill in the art without materially departing from the invention herein. For example, the present invention need not be limited to best mode disclosed herein, since other applications can equally benefit from the teachings of the present invention. Accordingly, all such modifications are intended to be included within the scope of this invention as defined in the following claims, in accordance with relevant law as to their interpretation.

What is claimed is:

1. A system configured to be mounted on a container for storing and dispensing a product, said system comprising:

a closure device configured to be disposed over a mouth portion of the container, said closure device comprising an opening for providing fluid communication between the container and a user and a stopper component, said stopper component configured to obstruct the opening during storage of the product and configured to be displaced from the opening to provide fluid communication through the opening during dispensing of the product;

an outflow component comprising an upper portion and a base, and configured to be in a folded position when not in use and an unfolded position to dispense the product to the user, the upper portion of said outflow component comprising an outflow aperture to provide a fluid communication between the outflow component and the user;

a securing member for supporting the outflow component in a position over the closure device, said securing member configured to receive the outflow component when said outflow component is in the folded position; and an enclosure member configured to be removably engageable with the securing member, wherein when the enclosure member is engaged with the securing member, the outflow component is compressed into a folded position, wherein at least a portion of the base of the outflow component obstructs the opening of the closure member during storage of the product, wherein when the enclosure member is disengaged from the securing member, the outflow component is released into the unfolded position, providing fluid communication through the opening of the closure device to dispense the product to the user;

wherein when the outflow component is in the folded position, said outflow component depresses said stopper component to obstruct the opening of the closure device to prevent fluid flow through the opening; and wherein when the outflow component is in the unfolded position, the stopper component is displaced from the opening allowing a flow of fluid there through.

2. The system of claim 1, wherein when the outflow component is in a folded position, a seal is formed between the base of the outflow component and the closure device to obstruct the opening and prevent fluid flow there through.

3. The system of claim 1, further comprising an enclosure member projection extending from the securing member, wherein said enclosure member projection depresses the stopper component into the opening upon engagement of the enclosure member over the outflow component, wherein when said enclosure member is released from the outflow component, the enclosure member projection is released from the stopper component, and the stopper component is displaced from the opening.

4. A system comprising:

a closure device, said closure device comprising an opening for providing fluid communication there through;

a stopper component removably engageable with said opening of said closure device, wherein when said stopper component is engaged with the opening, said stopper component obstructs the opening preventing a flow of fluid through the opening, wherein displacement of said stopper component from the opening allows fluid communication through the opening;

a securing member for supporting the outflow component in a position over the closure device; and an outflow component configured to be disposed over the closure device, said outflow component comprising an outflow aperture, to provide fluid communication between the outflow component and a user and a resilient material, that is pressed against the securing member to form a seal when the stopper component is in place and is released from the securing member to release the seal when the stopper component is displaced.

5. The system of claim 4, further comprising a container, said container comprising a mouth portion comprising an opening and a cavity configured to house a product deliverable to a user, wherein said closure device is associated with the mouth portion of the container, wherein said product is deliverable to the user through the outflow component of the system when said stopper component is displaced from the opening of the closure device.

6. The system of claim 4, further comprising an enclosure member, said enclosure member being removably engageable over said outflow component.

7. The system of claim 4, further comprising at least one of an actuation member and an actuator arm device to move the stopper component relative to the opening.

8. The system of claim 4, wherein the stopper component is configured to fit within the opening of closure device.

9. The system of claim 4, further comprising a spacer 57 disposed between the closer device and the stopper component.

10. A closure device configured to associate with a mouth of a container for storing and dispensing a product, said closure device comprising:

an upper surface and a lower surface, wherein said lower surface is in communication with the container;

an opening, said opening providing a fluid communication from the container through the closure device for dispensing the product from the container;

a stopper component, said stopper component is configured to obstruct the opening of the closure device when the stopper component is in an active position, and said stopper component is configured to move above the horizontal plane of the closure device to allow the product to be dispensed from the container through the opening when the stopper component is in an inactive position; and an enclosure member configured to engage with the closure device, said enclosure member comprising a protrusion member, said protrusion member extending from an inner surface of the enclosure member, said protrusion member configured to compress the stopper component toward the opening when the enclosure member is engaged with the closure device.

11. The closure device of claim 10, further comprising an outflow component, said outflow component comprising an outflow aperture for delivering the product from the container to a user, said outflow component being removably affixed to the closure device with a securing member.

12. The closure device of claim 11, wherein said outflow component comprises a resilient material, said outflow component being collapsible within the securing member, wherein when said outflow component is collapsed within aid securing member, at least a portion of said outflow component at least partially compresses said stopper component, such that said stopper component at least partially obstructs the opening preventing fluid flow there through.

13. The closure device of claim 12, wherein the stopper component is biased toward the outflow component, wherein when the outflow component is released, the stopper component is at least partially vertically displaced from the opening of the closure device to allow access to the opening providing fluid flow there through.

14. The closure device of claim 10, further comprising an enclosure member, said enclosure member being engageable over the outflow component.

15. The closure device of claim 14, wherein when the enclosure member is engaged over the outflow component, the enclosure member compresses the outflow component to collapse said outflow component into the securing member to prevent fluid flow through the opening.

16. The closure device of claim 15, wherein when the enclosure member disengaged from the outflow component, the outflow component is released from the securing member, releasing the stopper component from the opening to allow fluid flow through the opening into the outflow component.

17. The closure device of claim 14, wherein the enclosure member further comprises a protrusion member, said protrusion member extending from an inner surface of the enclosure member, said protrusion member comprises a protrusion member head at a distal end of the protrusion member, said protrusion member head being configured to associate with the outflow component aperture to obstruct the aperture or remove debris from the aperture when the enclosure member is engaged with the outflow component.

18. The closure device of claim 14, wherein said enclosure member further comprises an enclosure member projection extending from the enclosure member, said enclosure member projection configured to compress the stopper component such that the stopper component is placed over the opening to prevent fluid communication there through.

19. The closure device of claim 10, wherein the stopper component is further associated with an actuator mechanism, wherein said stopper component is configured to rotate over the opening in a plane transverse to the longitudinal axis of the container, wherein said rotation is relative to the movement of the actuator mechanism.

20. The closure device of claim 10, further comprising a spacer disposed between the closure device and the stopper component, such that when the enclosure member is engaged with the closure device, the protrusion member compresses the stopper component and the spacer forming a seal between the stopper component and the closure device opening, wherein when the enclosure member is disengaged for the closure device, the spacer expands allowing fluid communication through the opening.

* * * * *